US009765592B2

(12) United States Patent
Tolman et al.

(10) Patent No.: US 9,765,592 B2
(45) Date of Patent: Sep. 19, 2017

(54) SYSTEMS AND METHODS FOR SECONDARY SEALING OF A PERFORATION WITHIN A WELLBORE CASING

(71) Applicants: Randy C. Tolman, Spring, TX (US); Renzo M. Angeles Boza, Houston, TX (US); Kris J. Nygaard, Houston, TX (US); Christian S. Mayer, Pearland, TX (US); Pavlin B. Entchev, Moscow (RU)

(72) Inventors: Randy C. Tolman, Spring, TX (US); Renzo M. Angeles Boza, Houston, TX (US); Kris J. Nygaard, Houston, TX (US); Christian S. Mayer, Pearland, TX (US); Pavlin B. Entchev, Moscow (RU)

(73) Assignee: ExxonMobil Upstream Research Company, Spring, TX (US)

( * ) Notice: Subject to any disclaimer, the term of this patent is extended or adjusted under 35 U.S.C. 154(b) by 255 days.

(21) Appl. No.: 14/391,157

(22) PCT Filed: Apr. 15, 2013

(86) PCT No.: PCT/US2013/036624
§ 371 (c)(1),
(2) Date: Oct. 7, 2014

(87) PCT Pub. No.: WO2013/184238
PCT Pub. Date: Dec. 12, 2013

(65) Prior Publication Data

US 2015/0090453 A1 Apr. 2, 2015

Related U.S. Application Data

(60) Provisional application No. 61/656,337, filed on Jun. 6, 2012.

(51) Int. Cl.
*E21B 33/124* (2006.01)
*E21B 33/13* (2006.01)
(Continued)

(52) U.S. Cl.
CPC ..... *E21B 33/13* (2013.01); *E21B 27/02* (2013.01); *E21B 33/124* (2013.01);
(Continued)

(58) Field of Classification Search
None
See application file for complete search history.

(56) References Cited

U.S. PATENT DOCUMENTS 2,696,258 A 12/1954 Greene
2,808,888 A 10/1957 Teplitz
(Continued)

*Primary Examiner* — Jennifer H Gay
*Assistant Examiner* — Caroline Butcher
(74) *Attorney, Agent, or Firm* — ExxonMobil Upstream Research Company Law Department

(57) ABSTRACT

Systems and methods for secondary sealing of a perforation present within a wellbore casing associated with a primary sealing agent. The wellbore casing defines a casing conduit present within a wellbore that extends between a surface region and a subterranean formation. The systems and methods include a sealing apparatus that retains a charge of sealing material with a secondary sealing agent and is conveyed within the casing conduit to within a threshold distance of the perforation. The systems and methods further include selectively releasing the charge of sealing material from the sealing apparatus, such as by a release mechanism, to deliver the charge of sealing material to the perforation, to supplement the primary sealing agent (and/or a seal formed thereby), and/or to decrease a flow rate of a fluid from the casing conduit through the perforation.

36 Claims, 9 Drawing Sheets

(51) Int. Cl.

| | |
|---|---|
| ***E21B 33/138*** | (2006.01) |
| ***E21B 43/11*** | (2006.01) |
| ***E21B 43/14*** | (2006.01) |
| ***E21B 27/02*** | (2006.01) |

(52) U.S. Cl.
CPC ..... *E21B 33/138* (2013.01); *E21B 43/11* (2013.01); *E21B 43/14* (2013.01)

(56) References Cited

U.S. PATENT DOCUMENTS

| | | | |
|---|---|---|---|
| 3,241,613 | A | 3/1966 | Kern et al. |
| 4,187,909 | A | 2/1980 | Erbstoesser |
| 4,194,561 | A | 3/1980 | Stokley et al. |
| 4,410,387 | A | 10/1983 | Halkerston et al. |
| 4,505,334 | A | 3/1985 | Doner et al. |
| 4,756,371 | A | 7/1988 | Brieger |
| 5,191,931 | A | 3/1993 | Himes et al. |
| 5,253,709 | A | 10/1993 | Kendrick et al. |
| 5,485,882 | A | 1/1996 | Bailey et al. |
| 5,894,888 | A | 4/1999 | Wiemers et al. |
| 6,095,245 | A | 8/2000 | Mount |
| 6,380,138 | B1 | 4/2002 | Ischy et al. |
| 6,394,184 | B2 | 5/2002 | Tolman et al. |
| 6,497,284 | B2 | 12/2002 | van Petegem et al. |
| 6,520,255 | B2 | 2/2003 | Tolman et al. |
| 6,543,538 | B2 | 4/2003 | Tolman et al. |
| 6,575,247 | B2 | 6/2003 | Tolman et al. |
| 6,672,405 | B2 | 1/2004 | Tolman et al. |
| 6,915,856 | B2 | 7/2005 | Gentry et al. |
| 6,957,701 | B2 | 10/2005 | Tolman et al. |
| 7,059,407 | B2 | 6/2006 | Tolman et al. |
| 7,325,616 | B2 | 2/2008 | Lopez de Cardenas et al. |
| 7,353,871 | B2 | 4/2008 | Hromas et al. |
| 7,357,151 | B2 | 4/2008 | Lonnes |
| 7,467,778 | B2 | 12/2008 | Lonnes |
| 7,516,792 | B2 | 4/2009 | Lonnes et al. |
| 7,647,964 | B2 | 1/2010 | Akbar et al. |
| 7,703,507 | B2 | 4/2010 | Strickland |
| 7,735,559 | B2 | 6/2010 | Malone |
| 7,775,278 | B2 | 8/2010 | Willberg et al. |
| 7,814,970 | B2 | 10/2010 | Strickland |
| 8,029,026 | B2 | 10/2011 | Stolle et al. |
| 8,037,934 | B2 | 10/2011 | Strickland |
| 8,162,051 | B2 | 4/2012 | Strickland |
| 8,272,439 | B2 | 9/2012 | Strickland |
| 2005/0241835 | A1 | 11/2005 | Burris, II et al. |
| 2007/0187099 | A1 | 8/2007 | Wang |
| 2009/0101334 | A1 | 4/2009 | Baser et al. |
| 2009/0114385 | A1 | 5/2009 | Lumbye |
| 2009/0255674 | A1 | 10/2009 | Boney et al. |
| 2010/0051278 | A1 | 3/2010 | Mytopher et al. |
| 2010/0122813 | A1 | 5/2010 | Trummer et al. |
| 2010/0122814 | A1* | 5/2010 | Picou ..... E21B 27/02 166/278 |
| 2010/0200230 | A1 | 8/2010 | East, Jr. et al. |
| 2010/0200235 | A1 | 8/2010 | Luo et al. |
| 2011/0048122 | A1 | 3/2011 | Le Foll et al. |
| 2011/0226479 | A1 | 9/2011 | Tippel et al. |
| 2013/0062055 | A1 | 3/2013 | Tolman et al. |

* cited by examiner

SYSTEMS AND METHODS FOR SECONDARY SEALING OF A PERFORATION WITHIN A WELLBORE CASING

CROSS REFERENCE TO RELATED APPLICATIONS

This application is the National Stage of International Application No. PCT/US2013/036624, filed Apr. 15, 2013, which claims the benefit of U.S. Provisional Application No. 61/656,337, filed Jun. 6, 2012, the entirety of which is incorporated herein by reference for all purposes.

FIELD OF THE DISCLOSURE

The present disclosure is directed generally to systems and methods for the secondary sealing of perforations that are present in a wellbore casing, and more particularly to well completion systems and methods that utilize the secondary sealing.

BACKGROUND OF THE DISCLOSURE

A well may be utilized to form a fluid connection between a subterranean formation that includes a reservoir fluid and a surface region. The well may include a wellbore, or hole, that extends between the surface region and the subterranean formation, and the wellbore may contain, or be lined with, a wellbore casing that defines a casing conduit. Prior to beginning production, or conveyance, of reservoir fluid from the subterranean formation through the casing conduit to the surface region, one or more well completion operations may be performed to place the well in condition for production and/or to improve, or increase, a potential rate of wellbore fluid production therefrom.

Well completion operations often utilize a perforation device to form perforations within the wellbore casing. Subsequent to formation of the perforations, a stimulant fluid, such as a fracturing fluid and/or an acid, may be provided from the casing conduit, through the perforations, and to a portion of the subterranean formation that is proximal thereto. This stimulant fluid may alter the characteristics of the portion of the subterranean formation, thereby increasing a production rate of reservoir fluid from the well.

Often, it is desirable to fluidly isolate one or more selected perforations that are present within the wellbore casing from a remainder of the perforations that may be present within the wellbore casing to provide for more controlled delivery of the stimulant fluid to a selected portion of the subterranean formation that is proximal to the one or more selected perforations. Traditionally, this isolation has been accomplished by inserting a setting tool into the casing conduit to set a plug at a location within the casing conduit that is uphole from the perforations that are currently present within the casing conduit, which may fluidly isolate an uphole portion of the casing conduit from the perforations that are currently present within the casing conduit. Subsequent to setting the plug, a perforation device may be introduced into the casing conduit to create the one or more selected perforations at a location that is uphole from the plug.

The perforation device is then removed from the casing conduit, and the stimulant fluid may then be provided to a region of the casing conduit that is uphole from the one or more selected perforations. The plug directs the stimulant fluid through the one or more selected perforations and into the portion of the subterranean formation that is proximal thereto. The process may be repeated any suitable number of times to create any suitable number of perforations and stimulate any suitable number of portions of the subterranean formation.

While the above procedure may be effective at stimulating a plurality of portions of the subterranean formation, the process of inserting and/or positioning the various pieces of equipment into and/or within the casing conduit and subsequently removing the various pieces of equipment from the casing conduit prior to inserting and/or positioning the next piece of equipment into and/or within the casing conduit may increase the overall cost of the well completion operation, as well as the time required thereby. In addition, and after stimulation of a desired number of zones of the subterranean formation, the casing conduit will include a plurality of plugs that must be removed therefrom prior to production of reservoir fluids from an entire length of the well. It follows that removal of these plugs contributes additional time and expense to the well completion operation.

More recently, well completion operations have been developed that may decrease a number of plugs that may be needed for the completion operation, that may perforate and selectively stimulate a plurality of zones of the subterranean formation without removal of the perforation device from the casing conduit, and/or that may utilize other processes to temporarily fluidly isolate, or decrease fluid flow through, at least a portion of the plurality of perforations. For example, diversion agents, such as ball sealers, have been utilized to temporarily decrease fluid flow through one or more selected perforations. These diversion agents may be introduced into the casing conduit from the surface region while the perforation device is present within the casing conduit and may flow down the casing conduit with the stimulant fluid. Ideally, the stimulant fluid will direct the diversion agents toward the one or more selected perforations and provide for contact and sealing therebetween.

While such a system may be effective at decreasing fluid flow through a perforation, the sealing between the diversion agents and the perforations is often imperfect and/or may degrade over time. In addition, the distance between the surface region and the one or more selected perforations may be on the order of thousands, or even tens of thousands, of feet. Thus, the time required to pump the diversion agents from the surface region to the one or more selected perforations may be significant, or at least difficult to predict with certainty. Furthermore, the diversion agents may tend to disperse along the length of the casing conduit, making it difficult to provide the diversion agents to the one or more selected perforations at a target, or desired, concentration and/or increasing a potential for failure of the diversion agents to effectively seal a portion of the one or more selected perforations. In addition, the pumping and/or completion equipment may limit the types and/or sizes of diversion agents that may be provided to the casing conduit.

For example, conventionally, the diversion agents must flow from, or proximate, the surface region and past the perforation device that is downhole in the casing conduit in order to reach the one or more selected perforations. Additionally, the diversion agents must be introduced into the casing conduit while the casing conduit is under pressure, and the diversion agents typically must travel a long distance within the casing conduit prior to reaching the one or more selected perforations. Furthermore, processes that utilize diversion agents often may form and seal a limited number of perforations before a leakage rate through the perforations becomes significant relative to a flow rate of stimulant fluid into the casing conduit, thereby decreasing the flow rate of stimulant fluid into a target zone of the subterranean formation. In order to decrease and/or stop this leakage, packers or plugs may once again be utilized to fluidly isolate respective portions of the casing conduit, and these packers or plugs also must be removed from the casing conduit prior to production from the entire well. Thus, there exists a need for improved systems and methods for secondary sealing of perforations in a wellbore casing.

SUMMARY OF THE DISCLOSURE

Systems and methods for secondary sealing of a perforation that is present within a wellbore casing and is associated with a primary sealing agent. The wellbore casing may define a casing conduit and may be present within a wellbore that extends between a surface region and a subterranean formation. The systems and methods include a sealing apparatus that retains a charge of sealing material. The charge of sealing material includes a secondary sealing agent and may be conveyed within the casing conduit to within a threshold distance of the perforation. The systems and methods further include selectively releasing the retained charge of sealing material from the sealing apparatus, such as by a release mechanism, to deliver the charge of sealing material to the perforation, to supplement the primary sealing agent, and/or to decrease a flow rate of a fluid from the casing conduit through the perforation.

In some embodiments, the releasing includes releasing the charge of sealing material responsive to a trigger and/or event. In some embodiments, the charge of sealing material is contained or otherwise retained within a compartment of the sealing apparatus and/or forms at least a portion of the sealing apparatus. In some embodiments, the charge of sealing material includes not only the secondary sealing agent, but also a primary sealing agent and/or a supplemental material. In some embodiments, the secondary sealing agent is not suitable for delivery from the surface region and/or is delivered at a concentration that would be impractical to delivery from the surface region. In some embodiments, the releasing includes destroying at least a portion of the sealing apparatus to generate and/or release the charge of sealing material.

In some embodiments, the sealing apparatus forms a portion of a completion assembly that further includes a perforation device that is configured to create the perforation. In some embodiments, the systems and methods may be utilized to create a plurality of perforations within the wellbore casing and/or to seal the plurality of perforations, such as to provide for selective stimulation of a plurality of portions, or regions, of the subterranean formation that may be associated with and/or proximal to the plurality of perforations. In some embodiments, the systems and methods may be utilized to transition from completion and/or stimulation operations to production of reservoir fluids from a well that includes the wellbore. In some embodiments, the transitioning may include transitioning without removing a plug from the casing conduit.

DETAILED DESCRIPTION AND BEST MODE OF THE DISCLOSURE

Figure 1:
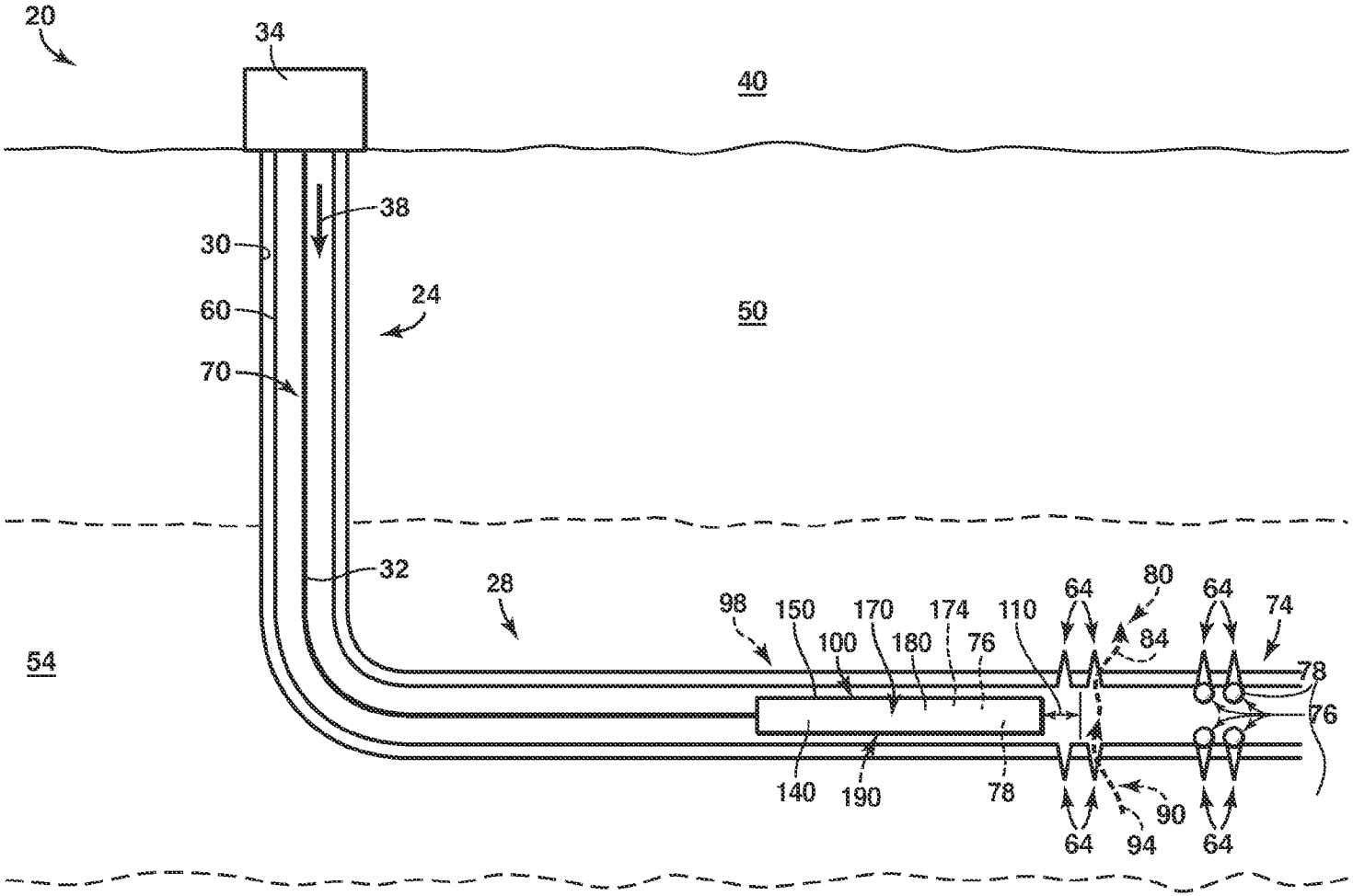
FIG. 1 is a schematic representation of illustrative, non-exclusive examples of a well that may be utilized with and/or include the systems and methods according to the present disclosure.

FIG. 1 is a schematic representation of illustrative, non-exclusive examples of a well 20 that may be utilized with and/or include the systems and methods according to the present disclosure. Well 20, which also may be referred to herein as a hydrocarbon well 20, includes a wellbore 30 that extends between a surface region 40 and a subterranean formation 54, and which may be present in a subsurface region 50. Well 20 further includes a wellbore casing 60 that is located within, extends within, and/or lines at least a portion of wellbore 20 and defines a casing conduit 70. Well 20, and/or wellbore 30 thereof, further may include a vertical portion 24 and/or a horizontal portion 28.

As used herein, the phrase, "wellbore casing" may refer to any suitable structure that may be located, may extend, and/or may be placed within wellbore 30 to create and/or define casing conduit 70. As illustrative, non-exclusive examples, wellbore casing 60 also may be referred to herein as casing string 60 and/or liner 60. It is within the scope of the present disclosure that the wellbore casing may be cemented, or otherwise retained, within the wellbore. Alternatively, it is also within the scope of the present disclosure that the wellbore casing may not be cemented within the wellbore and/or that the wellbore casing may be referred to herein as an uncemented wellbore casing, an uncemented casing string, and/or an uncemented liner.

Subsequent to formation of wellbore 30 and installation of wellbore casing 60 therein, it may be desirable to form one or more perforations 64 within the wellbore casing. As indicated in FIG. 1 at 80, these perforations may be utilized during stimulation operations, such as to convey a fluid 84, such as a stimulant fluid, from casing conduit 70 and into a portion of subterranean formation 54 that is proximal to perforations 64. As illustrative, non-exclusive examples, the stimulant fluid may include acid and/or a proppant, and it typically is pumped through the perforations and into the subterranean formation at relatively high flow rates and/or pressures. Additionally or alternatively, and as indicated in FIG. 1 at 90, these perforations may be utilized during production operations, such as to convey a fluid 94, such as a reservoir fluid, from subterranean formation 54, into casing conduit 70, and thereafter to surface region 40.

During stimulation operations, and as discussed in more detail herein, it may be desirable to provide for flow of a fluid 84 from casing conduit 70 through a selected, target, and/or desired perforation 64 and/or a plurality of selected perforations 64, while limiting, occluding, and/or blocking a flow of the fluid through a remainder of the perforations that may be present within wellbore casing 60. Thus, and as indicated in FIG. 1 at 74, one or more primary sealing agents 76 may limit flow of the stimulant fluid through one or more selected perforations 64.

Primary sealing agents 76 may be designed, configured, selected, and/or sized to form a temporary seal with respective perforations 64 of wellbore casing 60. As an illustrative, non-exclusive example, and as illustrated schematically in FIG. 1, primary sealing agents 76 may include ball sealers 78 that may at least partially block, or seal, perforations 64 while remaining within casing conduit 70. Thus, maintaining a positive pressure within casing conduit 70 relative to subterranean formation 54 (such as by maintaining a pressure within the casing conduit to be greater than a pressure within the subterranean formation) may provide a driving force for maintaining a sealing engagement between primary sealing agents 76 and perforations 64 that limits, and ideally prevents, the flow of fluid from the casing conduit through the perforations. However, loss and/or removal of the positive pressure within casing conduit 70 relative to subterranean formation 54 (or a decrease in the positive pressure within the casing conduit to below a threshold positive pressure) may provide for removal of primary sealing agents 76 from (or at least removal of sealing engagement with) perforations 64.

Figure 2:
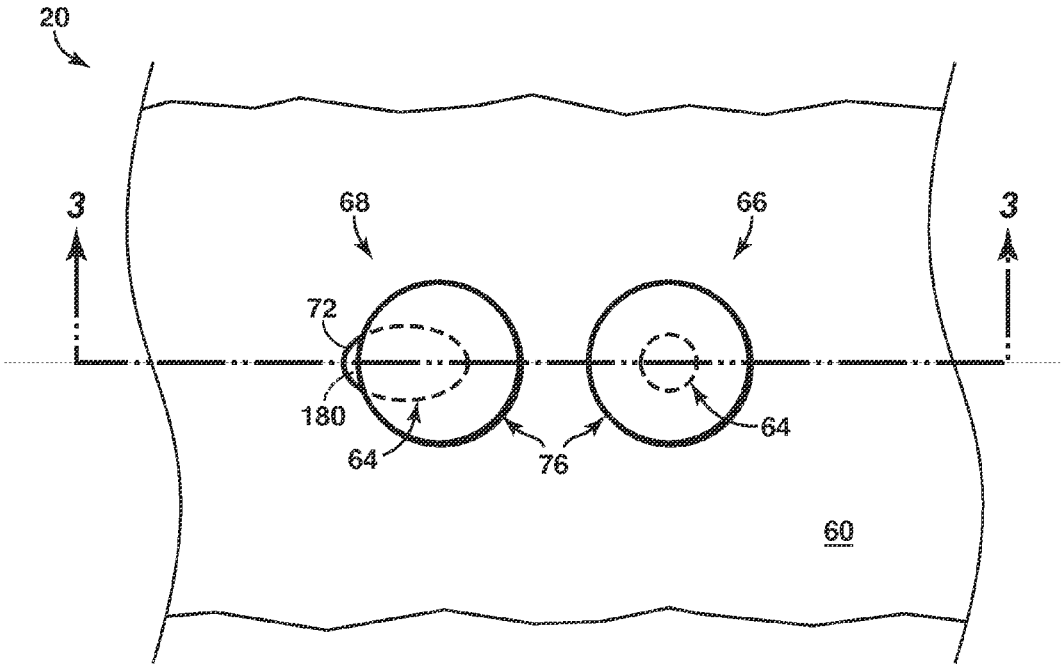
FIG. 2 is a schematic representation of an illustrative, non-exclusive example of a region of a wellbore casing that includes a plurality of perforations, wherein each of the plurality of perforations is associated with a respective primary sealing agent.
Figure 3:
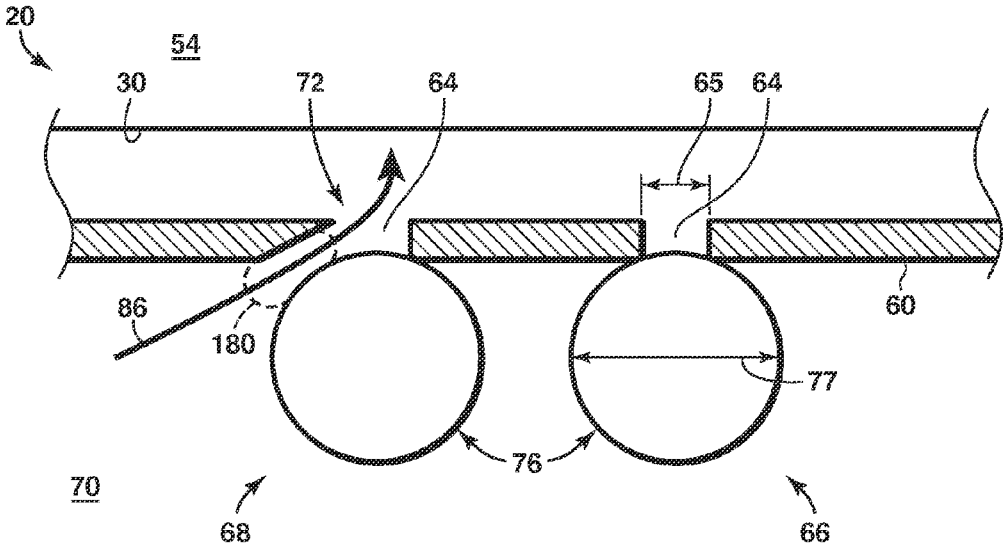
FIG. 3 is a schematic representation of the region of a wellbore casing of FIG. 2 taken along the line 3-3 in FIG. 2.

While primary sealing agents 76 may be effective at decreasing the flow of fluid from casing conduit 70 through perforations 64, the sealing between primary sealing agents 76 and perforations 64 may be, and often is, imperfect. This is illustrated in FIGS. 2 and 3, which provide schematic representations of an illustrative, non-exclusive example of a wellbore casing 60 that includes a plurality of perforations 64. As depicted, each of the plurality of perforations is associated with a respective primary sealing agent 76. FIG. 2 illustrates wellbore casing 60, perforations 64, and primary sealing agents 76 as viewed from inside the casing conduit, while FIG. 3 provides a cross-sectional view of wellbore 30, casing conduit 70, wellbore casing 60, perforations 64, and primary sealing agents 76 as viewed along line 3-3 of FIG. 2.

As indicated in FIGS. 2 and 3 at 66, perforations 64 may include and/or define a regular, desired, target, expected, and/or circular shape, opening and/or void within wellbore casing 60. When perforations 64 include a regular shape, primary sealing agent 76 may be designed, sized, and/or configured to form an effective seal therewith, thereby limiting, occluding, blocking, and/or stopping a flow of fluid from casing conduit 70, through perforation 64, and into subterranean formation 54.

Additionally or alternatively, and as indicated in FIGS. 2 and 3 at 68, perforations 64 also may include and/or define an irregular, unexpected, deformed, teardrop, ovate, and/or non-circular shape. This irregular shape may be present when the perforation is formed, such as due to an orientation and/or position of the perforation gun, perforation charge, and/or other perforation device used to form the perforation. Additionally or alternatively, the perforation may elongate, "tear drop," and/or otherwise change in shape over time, such as responsive to abrasion as stimulant fluid and/or proppant flow therethrough, to produce the irregular shape.

When perforations 64 include an irregular shape, primary sealing agent 76 may form an ineffective, or partial, seal therewith. Thus, and as indicated in FIG. 3 at 86, a portion of the fluid may leak past, or bypass, primary sealing agent 76, such as through leakage pathway 72. When this occurs, it may be difficult to effectively stimulate the formation through other perforations, to otherwise maintain a desired positive pressure within the casing conduit, and/or to maintain other seals between other primary sealing agents and their respective perforations. Thus, the systems and methods according to the present disclosure may be configured to provide a secondary sealing agent 180 to leakage pathway 72, thereby blocking, occluding, restricting, and/or decreasing the leakage pathway and/or a size thereof, and decreasing flow of fluid 86 through the leakage pathway.

Returning to FIG. 1, a sealing apparatus 100 according to the present disclosure may be located, at least temporarily, within casing conduit 70 and may be in mechanical and/or electrical communication with surface region 40 via working line 32. In FIG. 1, sealing apparatus 100 is illustrated as being present within horizontal portion 28 of well 20 and within a threshold distance 110 of one or more perforations 64. However, it is within the scope of the present disclosure that sealing apparatus 100 may be located in any suitable portion of well 20, including vertical portion 24. Additionally or alternatively, it is also within the scope of the present disclosure that threshold distance 110 may include any suitable distance, illustrative, non-exclusive examples of which include threshold distances of less than 500 meters (m), less than 400 m, less than 300 m, less than 200 m, less than 100 m, less than 75 m, less than 50 m, less than 40 m, less than 30 m, less than 20 m, less than 15 m, less than 10 m, less than 5 m, or less than 1 m.

As illustrated in FIG. 1, sealing apparatus 100 may form a portion of a completion assembly 98 that is configured to perform one or more completion operations on well 20. As discussed in more detail herein with reference to FIGS. 10-11, completion assembly 98 further may include a perforation device 190 that is configured to form perforations 64 within wellbore casing 60.

Sealing apparatus 100 may include a charge of sealing material 170 that includes at least a secondary sealing agent 180. The sealing apparatus also may include a delivery structure 150, which may retain charge of sealing material 170 within sealing apparatus 100 during conveyance of the sealing apparatus from surface region 40 to within threshold distance 110 of perforations 64. As used herein, the term "retain" means that delivery structure 150 includes, houses, contains, encloses, and/or defines charge of sealing material 170 in any suitable manner such that the charge of sealing material may be conveyed with sealing apparatus 100, along casing conduit 70, and to within threshold distance 110 of perforations 64. As an illustrative, non-exclusive example, the charge of sealing material, or at least a portion thereof, may be retained such that a concentration of the charge of sealing material is at least substantially unchanged while the sealing apparatus is conveyed along the casing conduit. As another illustrative, non-exclusive example, the charge of sealing material, or at least a portion thereof, may be retained such that the charge of sealing material moves with the sealing apparatus while the sealing apparatus is conveyed along the casing conduit. As yet another illustrative, non-exclusive example, the charge of sealing material, or at least a portion thereof, may be retained in fluid isolation (within the sealing apparatus) from fluid 38 that may be present within casing conduit 70 while the sealing apparatus is conveyed along the casing conduit. As another illustrative, non-exclusive example, the charge of sealing material, or at least a portion thereof, may be retained such that the charge of sealing material does not disperse along a length of casing conduit 70 while the sealing apparatus is conveyed along the casing conduit.

Sealing apparatus 100 further may include a release mechanism 140, which may selectively release the charge of sealing material from the sealing apparatus and into the casing conduit to supplement the seal between wellbore casing 60 and primary sealing agent 76, such as to decrease a leakage rate, or flow rate, of fluid stream 86 from casing conduit 70 through perforations 64 and/or through a leakage pathway 72 thereof (as illustrated in FIG. 3). Illustrative, non-exclusive examples of sealing apparatus 100 and/or delivery structures 150 according to the present disclosure are discussed in more detail herein with reference to FIGS. 4-8, and it is within the scope of the present disclosure that any of these illustrated sealing apparatus 100 and/or delivery structures 150 may be incorporated into and/or form a portion of sealing apparatus 100 of FIG. 1 and/or any of the other sealing apparatus 100 that are disclosed herein.

Charge of sealing material 170 includes secondary sealing agent 180 and may be formed from any suitable material of construction and/or may define any suitable shape and/or size. As an illustrative, non-exclusive example, charge of sealing material 170 may include primary sealing agent 76, such as ball sealers 78, in addition to secondary sealing agent 180. As yet another illustrative, non-exclusive example, charge of sealing material 170 may include one or more supplemental materials 174.

Secondary sealing agent 180 may include any suitable structure. As illustrative, non-exclusive examples, the secondary sealing agent may include a web of material, a woven mat of material, strands of material, a random collection of fibers, a plurality of small spheres, a plurality of small spheres that define a plurality of sphere diameters, a plurality of particles, a plurality of particles that define a plurality of particle characteristic dimensions, a granular material, particulate material, and/or powdered material.

Similarly, secondary sealing agent 180 may include any suitable size and/or characteristic dimension, such as a characteristic diameter, an equivalent diameter, a characteristic thickness, and/or a characteristic length. As an illustrative, non-exclusive example, a characteristic dimension of the secondary sealing agent may be less than a characteristic dimension of primary sealing agent 76 and/or less than a characteristic dimension of perforation 64. This may include secondary sealing agents with a characteristic dimension that is less than 50%, less than 40%, less than 30%, less than 20%, less than 10%, less than 5%, less than 2.5%, or less than 1% of the characteristic dimension of the primary sealing agent and/or the characteristic dimension of the perforation.

As used herein, the phrase, "characteristic dimension" may refer to any suitable measure of any suitable characteristic, or representative, dimension of the secondary sealing agent, the primary sealing agent, and/or the perforation (or any other component of well 20 and/or sealing apparatus 100). As an illustrative, non-exclusive example, the characteristic dimension may include an average, such as a mean, median, and/or mode, thickness, diameter, and/or length of the secondary sealing agent. It is within the scope of the present disclosure that, when the secondary sealing agent includes a regular geometric shape, the characteristic dimension may include an actual measure of the geometric shape. Additionally or alternatively, and when the secondary sealing agent does not include a regular geometric shape, the characteristic dimension may include an idealized and/or representative measure of the shape of the secondary sealing agent.

As an illustrative, non-exclusive example, and when the secondary sealing agent includes a plurality of secondary sealing agent bodies with a circular cross-sectional shape, the characteristic dimension may include a diameter of the plurality of secondary sealing agent bodies and/or an average diameter of the plurality of secondary sealing agent bodies. As another illustrative, non-exclusive example, and when the secondary sealing agent includes a plurality of secondary sealing agent bodies with an irregular cross-sectional shape, the characteristic dimension may include a diameter of a sphere that includes the same volume as an average volume of the plurality of secondary sealing agent bodies. As yet another illustrative, non-exclusive example, and regardless of a conformation of the plurality of secondary sealing agent bodies, the characteristic dimension may include an average maximum extent (which may be measured in any suitable direction) of the plurality of secondary sealing agent bodies.

Thus, and as illustrated in FIG. 3, secondary sealing agent 180 may be configured and/or sized to seal a perforation that is partially blocked, or already partially blocked, by primary sealing agent 76. Secondary sealing agent 180 thus may be configured to form a temporary seal between the wellbore casing and the primary sealing agent. Thus, and as discussed in more detail herein with reference to primary sealing agent 76, the secondary sealing agent may be configured to be removed from perforation 64 responsive to a decrease, loss, and/or removal of the positive pressure within casing conduit 70. Additionally or alternatively, secondary sealing agent 180 may be configured to (temporarily and/or reversibly) seal a leakage pathway 72 that includes a smaller characteristic dimension than the characteristic dimension of perforation 64 that defines a portion of the leakage pathway.

Returning to FIGS. 1-3, secondary sealing agent 180 also may include any suitable materials of construction. As illustrative, non-exclusive examples, the secondary sealing agent may be formed from any suitable polymeric material, metallic material, composite material, naturally occurring material, granular material, powdered material, biodegradable material, ceramic material, frangible material, magnetic material, ferromagnetic material, frangible magnetic material, frangible ferromagnetic material, paramagnetic material, expandable material, material that is configured to expand upon release from the sealing apparatus and/or from the delivery structure thereof, material that expands upon exposure to fluid 38, material that expands upon absorption of fluid 38, compressed material that expands upon removal of a compressive force (such as compressive force that is applied prior to release of the secondary sealing agent from the sealing apparatus and which is not present after release of the secondary sealing agent from the sealing apparatus), compressed material that is encapsulated in an encapsulation material that is soluble in fluid 38 and that expands upon dissolution of the encapsulation material within fluid 38, sponge, compressed sponge, steel wool, fiberglass, fiberglass insulation, wood, and/or any combination thereof.

Secondary sealing agent 180 may not include materials that are configured to form a permanent seal within well 20, such as unset concrete, and/or materials that may function as a primary sealing agent, such as ball sealers 78. Additionally or alternatively, and since sealing apparatus 100 is configured to release charge of sealing material 170, including secondary sealing agent 180, within casing conduit 70 and within threshold distance 110 of perforations 64, charge of sealing material 170 and/or secondary sealing agent 180 may include one or more materials that cannot be provided to casing conduit 70 through a pump 34 that is configured to supply a fluid 38 to casing conduit 70. This may include materials that may abrade pump 34, may damage pump 34, and/or may occlude pump 34 if supplied to casing conduit 70 therethrough. This also may include materials with a high viscosity and/or a high solids content that may not readily flow through pump 34.

Thus, secondary sealing agent 180 may be configured to be retained between wellbore casing 60 and primary sealing agent 76 when the pressure within casing conduit 70 is greater (or greater by at least a threshold positive pressure magnitude) than the pressure within subterranean formation 54. Similarly, secondary sealing agent 180 may be configured to be released from between wellbore casing 60 and primary sealing agent 76 when the pressure within casing conduit 70 is less than the pressure within subterranean formation 54, when the pressure within casing conduit 70 is less than the pressure within subterranean formation 54 by more than a threshold negative pressure magnitude, and/or when the pressure in casing conduit 70 is greater than the pressure within subterranean formation 54 but not greater by at least the threshold positive pressure magnitude.

Secondary sealing agent 180 may obstruct and/or seal the leak, or leakage pathway 72, between wellbore casing 60 and primary sealing agent 76 in any suitable manner. As an illustrative, non-exclusive example, the secondary sealing agent may include a plurality of secondary sealing agent bodies that may be configured to aggregate, accumulate, and/or agglomerate between the primary sealing agent and the wellbore casing. This plurality of secondary sealing agent bodies may be sized to combine proximal to primary sealing agent 76, wellbore casing 60, and/or leakage pathway 72 to decrease the leakage rate of fluid stream 86.

As another illustrative, non-exclusive example, secondary sealing agent 180 may be configured to collect, aggregate, accumulate, and/or agglomerate one or more particulates, such as a proppant, that may be present within the fluid that is contained within casing conduit 70 and to thereby decrease the flow rate of fluid stream 86 and/or decrease the size of leakage pathway 72 (as illustrated in FIG. 3).

It is within the scope of the present disclosure that, in addition to secondary sealing agent 180, charge of sealing material 170 optionally also may include one or more primary sealing agents 76. In contrast with secondary sealing agent 180, and as illustrated in FIGS. 1-3, primary sealing agent 76 may be sized and/or configured to seal, partially seal, and/or at least substantially seal, perforations 64. Thus, and as illustrated in FIG. 3, a characteristic dimension 77 of primary sealing agent 76 may be selected to be greater than a characteristic dimension 65 of perforation 64. This may include characteristic dimensions 77 of primary sealing agent 76 that are at least 150%, at least 200%, at least 225%, at least 250%, at least 275%, at least 300%, at least 350%, at least 400%, at least 450%, or at least 500% greater than characteristic dimension 65 of perforation 64. Illustrative, non-exclusive examples of characteristic dimensions are discussed in more detail herein with reference to secondary sealing agent 180.

The inclusion of primary sealing agents 76 in charge of sealing material 170 may provide additional flexibility in the design, selection, and/or construction of primary sealing agents 76. As an illustrative, non-exclusive example, and when primary sealing agents 76 are provided to casing conduit 70 by flowing in fluid 38 from surface region 40, a size, characteristic dimension, and/or diameter of the primary sealing agents and/or sealing apparatus 100 may be limited to provide for conveyance of the primary sealing agent past the sealing apparatus. Thus, the characteristic dimension of the primary sealing agent and/or an outer diameter of the sealing apparatus may be limited such that a difference between an inner diameter of wellbore casing 60 and the outer diameter of sealing apparatus 100 is greater than the characteristic dimension, or diameter, of primary sealing agent 76.

In contrast, and when primary sealing agent 76 is included within charge of sealing material 170, the primary sealing agent may be released from a downhole end of the sealing apparatus and may not flow past the sealing apparatus during conveyance to perforations 64. Therefore, the diameter of the primary sealing agent may be selected to be larger than the difference between the inner diameter of the wellbore casing and the outer diameter of the sealing apparatus. This may provide additional flexibility in the sizing and/or construction of the primary sealing agent.

Release of primary sealing agent 76 from sealing apparatus 100 when the sealing apparatus is within threshold distance 110 of perforations 64 may decrease a time that is needed for the primary sealing agent to reach the perforation and/or may increase the likelihood that the primary sealing agent reaches a respective perforation. This may increase the overall efficiency of the sealing process.

An illustrative, non-exclusive example of primary sealing agents 76 according to the present disclosure includes ball sealers 78. Additional illustrative, non-exclusive examples of primary sealing agents 76 according to the present disclosure include primary sealing agents that are configured to persist within casing conduit 70 for a target sealing time and then to degrade within the casing conduit, primary sealing agents that are configured to deform when in sealing contact with wellbore casing 60 and/or perforation 64, primary sealing agents that are configured to biodegrade within casing conduit 70, primary sealing agents that include a hard core with a softer outer coating, and/or primary sealing agents that include a hard ceramic magnet with a softer outer coating.

In addition to secondary sealing agent 180, and optionally primary sealing agent 76, delivery structure 150 also may retain one or more supplemental materials 174. Illustrative, non-exclusive examples of supplemental materials 174 according to the present disclosure include materials that do not function as a sealing agent, tracer materials, chemical tracers, radioactive tracers, and/or materials that are configured to stimulate subterranean formation 54.

Regardless of the composition of charge of sealing material 170 and/or the specific materials, components, and/or sealing agents that are included therein, at least a portion, if not all, of the charge of sealing material optionally may be biodegradable and/or may be configured to degrade within casing conduit 70. In addition, the charge of sealing material may include any suitable configuration within sealing apparatus 100 and/or delivery structure 150 thereof. As an illustrative, non-exclusive example, the charge of sealing material may define a packed bed of sealing material.

As another illustrative, non-exclusive example, the charge of sealing material may define a release concentration while retained within sealing apparatus 100 and/or delivery structure 150 thereof. The release concentration may include any suitable measure of the concentration of the charge of sealing material while the charge of sealing material is retained within the sealing apparatus. As illustrative, non-exclusive examples, the release concentration may be defined as a ratio of a volume of the charge of sealing material to a volume of delivery structure 150, a ratio of a volume of the charge of sealing material to a volume of a space that may contain the charge of sealing material, and/or a volume % of solids within a given volume of the charge of sealing material. Illustrative, non-exclusive examples of release concentrations according to the present disclosure include release concentrations of at least 20 volume %, at least 30 volume %, at least 40 volume %, at least 50 volume %, at least 60 volume %, at least 70 volume %, at least 80 volume %, at least 90 volume %, at least 95 volume %, at least 99 volume %, or 100 volume %.

As discussed, sealing apparatus 100 also includes release mechanism 140 that is configured to selectively release charge of sealing material 170 from sealing apparatus 100 and/or from delivery structure 150 thereof. It is within the scope of the present disclosure that release mechanism 140 may include any suitable structure and/or composition, illustrative, non-exclusive examples of which include any suitable explosive device, mechanical actuator, electrical actuator, catch, and/or servo.

FIGS. 4-8 are schematic representations of illustrative, non-exclusive examples of sealing apparatus 100 and/or delivery structures 150 according to the present disclosure. As discussed herein with reference to FIG. 1, delivery structures 150 retain charge of sealing material 170, which includes secondary sealing agent 180, during conveyance of sealing apparatus 100 between a surface region and through a casing conduit to within a threshold distance of one or more perforations within a wellbore casing. In addition, and as also discussed herein with reference to FIG. 1, delivery structures 150 also may retain a primary sealing agent 76 and/or one or more supplemental materials 174. Furthermore, delivery structures 150 may include a closure 144 that cooperates with release mechanism 140 to selectively release the charge of sealing material from the sealing apparatus and/or from the delivery structure thereof.

In FIGS. 4-8, like elements are denoted by like numbers, and each element may not be discussed in detail herein with reference to each of FIGS. 4-8. However, any individual element and/or combination of elements that is disclosed in any of FIGS. 4-8 may be utilized in any of the sealing apparatus that are disclosed herein without departing from the scope of the present disclosure.

Figure 4:
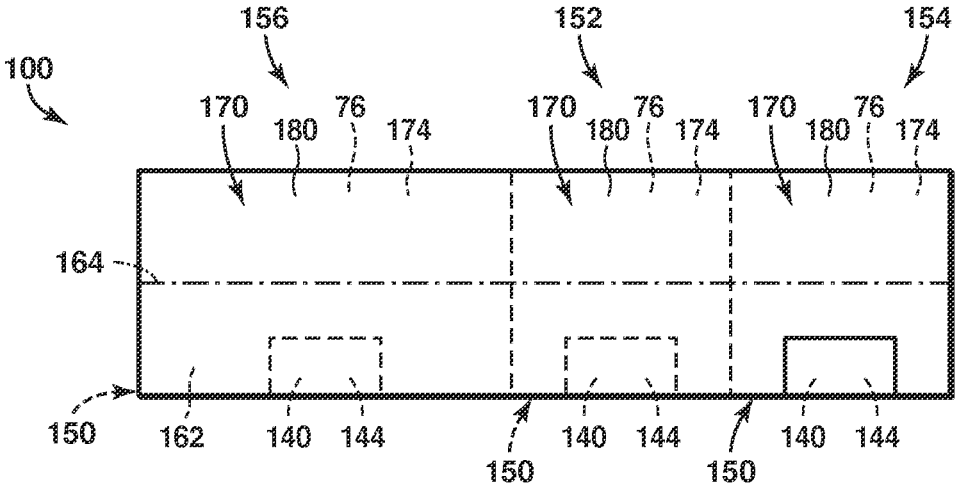
FIG. 4 is a schematic representation of illustrative, non-exclusive examples of a sealing apparatus and/or a delivery structure according to the present disclosure.

In the illustrative, non-exclusive example of FIG. 4, sealing apparatus 100 is illustrated as including a plurality of delivery structures 150, each of which includes a respective release mechanism 140. While three delivery structures 150 and three release mechanisms 140 are illustrated in FIG. 4, it is within the scope of the present disclosure that sealing apparatus 100 may include any suitable number of delivery structures 150 that may include separate, or dedicated, release mechanisms 140 and/or shared release mechanisms 140.

As an illustrative, non-exclusive example, and when sealing apparatus 100 includes a plurality of delivery structures 150 and a respective plurality of release mechanisms 140, each of the plurality of release mechanisms 140 may be configured to selectively and/or independently release a respective charge of sealing material 170 from a respective delivery structure 150 without releasing a remainder of the charge of sealing material 170 that is retained by a remainder of the delivery structures 150. As another illustrative, non-exclusive example, a selected release mechanism may be configured to release charge of sealing material 170 from a plurality of delivery structures 150.

It is within the scope of the present disclosure that, as indicated in FIG. 4 at 152 and 154, a portion of the plurality of delivery structures 150 may include the same, or at least substantially the same, size and/or volume and/or that a portion of the plurality of delivery structures 150 may retain the same, or at least substantially the same, quantity, amount, mass, and/or volume of charge of sealing material 170. However, it is also within the scope of the present disclosure that, as indicated in FIG. 4 at 156, a portion of the plurality of delivery structures 150 may include a different size and/or volume and/or may retain a different quantity, amount, mass, and/or volume of charge of sealing material 170 when compared to a remainder (as indicated at 152 and 154) of the plurality of delivery structures 150.

Similarly, it is within the scope of the present disclosure that charge of sealing material 170 that is retained within each delivery structure 150 may be similar and/or may include the same, or at least a similar, composition. However, it is also within the scope of the present disclosure that a portion of the plurality of delivery structures may retain a charge of sealing material that is different from and/or includes a different composition than a charge of sealing material that is retained in a remainder of the plurality of delivery structures 150. As an illustrative, non-exclusive example, a first delivery structure may retain primary sealing agent 76 and a second delivery structure may retain secondary sealing agent 180.

Figure 6:
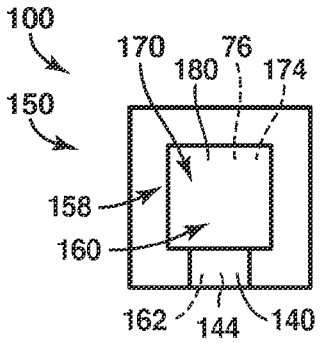
FIG. 6 is another schematic representation of illustrative, non-exclusive examples of a sealing apparatus and/or a delivery structure according to the present disclosure.
Figure 7:
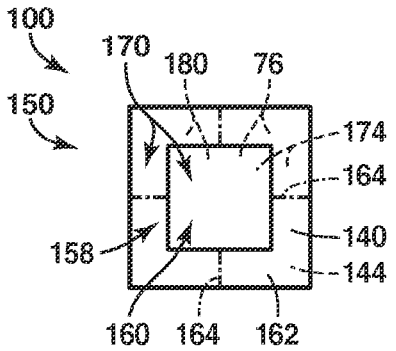
FIG. 7 is another schematic representation of illustrative, non-exclusive examples of a sealing apparatus and/or a delivery structure according to the present disclosure.
Figure 8:
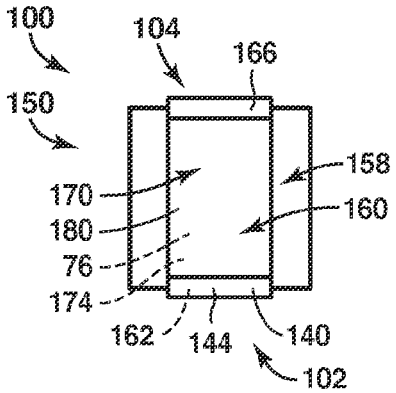
FIG. 8 is another schematic representation of illustrative, non-exclusive examples of a sealing apparatus and/or a delivery structure according to the present disclosure.

As schematically illustrated in FIGS. 6-8, delivery structure 150 may include a delivery structure body 158 that defines an internal chamber, or internal compartment, 160. Internal chamber 160 may contain, house, enclose, and/or retain at least a portion of charge of sealing material 170, and release mechanism 140 may be configured to selectively release the charge of sealing material from internal chamber 160.

Release mechanism 140 may be configured to release charge of sealing material 170 from delivery structure 150 in any suitable manner. As an illustrative, non-exclusive example, and as schematically illustrated in FIGS. 4-8, release mechanism 140 may cooperate with closure 144, such as by opening closure 144, to release the charge of sealing material from the delivery structure. As another illustrative, non-exclusive example, and as also illustrated in FIGS. 4-8, at least a portion of sealing apparatus 100 and/or delivery structure 150 thereof may include and/or be a frangible material 162.

Frangible material 162, which also may be referred to herein as friable material 162 and/or destructible material 162, may include any suitable material that is configured to break apart, fracture, disintegrate, separate, crumble, shatter, and/or crack, such as into small, or even very small, pieces. As an illustrative, non-exclusive example, a frangible or friable material may be broken into particulate and/or granular material, such as particulate and/or granular material having the properties and/or characteristic dimensions of the secondary sealing agent described herein. The frangible material may break apart upon application of a fracture stress thereto by release mechanism 140, such as by explosion of an explosive device that is included in the release mechanism. Illustrative, non-exclusive examples of frangible materials according to the present disclosure include brittle materials, plastics, glasses, and/or ceramics.

When sealing apparatus 100 and/or delivery structure 150 includes frangible material 162, it is within the scope of the present disclosure that the frangible material may form any suitable portion of the sealing apparatus and/or the delivery structure. As illustrative, non-exclusive examples, the frangible material may form a portion, or all, of delivery structure body 158, an end of the delivery structure, a downhole end of the delivery structure, and/or an end cap that is operatively attached to the delivery structure.

In addition, it is also within the scope of the present disclosure that frangible material 162 may form a portion and/or all of charge of sealing material 170. As an illustrative, non-exclusive example, frangible material 162 may break apart to generate the portion of the charge of sealing material and/or at least secondary sealing agent 180 thereof. Illustrative, non-exclusive examples of the portion of the charge of sealing material include at least 10%, at least 20%, at least 30%, at least 40%, at least 50%, at least 60%, at least 70%, at least 80%, at least 90%, or 100% of the charge of sealing material, and/or less than 90%, less than 80%, less than 70%, less than 60%, less than 50%, less than 40%, or less than 30% of the charge of sealing material.

In FIG. 4, any suitable portion of delivery structure 150 may be formed from frangible material 162. FIG. 4 also illustrates that, when delivery structure 150 includes frangible material 162, the frangible material may include and/or define one or more relief lines 164. Relief lines 164 may be configured, sized, and/or located to decrease a magnitude of the fracture stress that is needed to break apart frangible material 162 and/or to direct frangible material 162 to break apart in specified locations, such as on and/or near relief lines 164.

Figure 5:
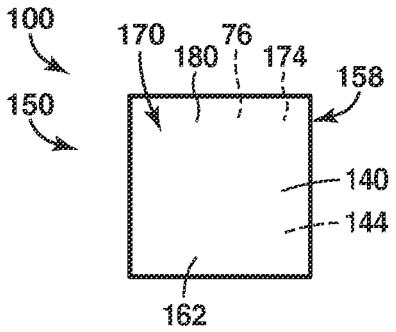
FIG. 5 is another schematic representation of illustrative, non-exclusive examples of a sealing apparatus and/or a delivery structure according to the present disclosure.

In the illustrative, non-exclusive example of FIG. 5, delivery structure 150 (or delivery structure body 158 thereof) and charge of sealing material 170 are both defined by frangible material 162, and application of the fracture stress by release mechanism 140 breaks apart delivery structure 150 to produce charge of sealing material 170 that includes secondary sealing agent 180. In the illustrative, non-exclusive example of FIG. 6, delivery structure body 158 is not formed from a frangible material, and release mechanism 140 selectively opens closure 144 to release charge of sealing material 170 from internal chamber 160. It is within the scope of the present disclosure that, as discussed in more detail herein, closure 144 may be mechanically and/or electrically actuated and/or may not include frangible material 162. However, it is also within the scope of the present disclosure that closure 144 may include frangible material 162.

Regardless of the specific mechanism that may be utilized to release charge of sealing material 170 from delivery structure 150, delivery structure body 158 of FIG. 6 (and other delivery structure bodies disclosed herein that do not include a frangible material) also may be referred to herein as a reusable delivery structure body. As such, it is within the scope of the present disclosure that the delivery structure body may be removed from casing conduit 70, such as to surface region 40, closure 144 may be reset (such as by closing the closure and/or replacing a frangible component thereof), release mechanism 140 may be reset (such as by configuring for re-use and/or replacing an explosive charge thereof), a new charge of sealing material may be placed within internal chamber 160, and delivery structure 150 may be utilized a second, or subsequent, time within casing conduit 70 to deliver the new charge of sealing material to one or more target perforations within wellbore casing 60.

In the illustrative, non-exclusive example of FIG. 7, delivery structure body 158 is formed from frangible material 162 and may include relief lines 164. Application of the fracture stress to the frangible material breaks apart the frangible material, releasing a portion of charge of sealing material 170 from internal compartment 160. In addition, and as discussed in more detail herein, frangible material 162 may form a portion of the overall charge of sealing material that is released from sealing assembly 100.

In the illustrative, non-exclusive example of FIG. 8, delivery structure body 158 is not formed from a frangible material, and closure 144, which may be located on and/or near a downhole end 102 of sealing apparatus 100, may be formed from a frangible or a non-frangible material. In addition, sealing apparatus 100 also includes an inflow port 166, which may be located on and/or near an uphole end 104 of sealing apparatus 100, and which may provide for a flow of fluid through the sealing apparatus subsequent to opening of closure 144. This may provide for improved removal of charge of sealing material 170 from sealing apparatus 100, increase an efficiency of removal of the charge of sealing material from the sealing apparatus, increase a rate at which the charge of sealing material is released from the sealing apparatus, and/or increase a concentration of the charge of sealing material within the casing conduit subsequent to release from the sealing apparatus by decreasing dispersion of the charge of sealing material within the casing conduit.

Figure 9:
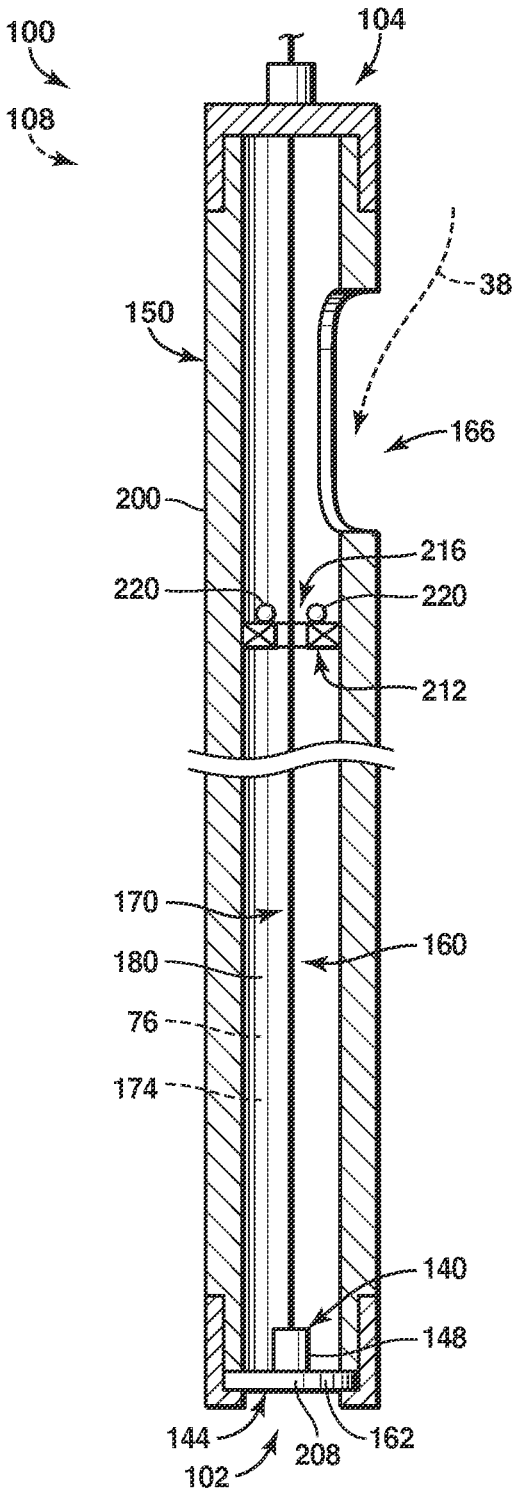
FIG. 9 is a less schematic but still illustrative, non-exclusive example of another sealing apparatus according to the present disclosure.

FIG. 9 is a less schematic but still illustrative, non-exclusive example of another sealing apparatus 100 according to the present disclosure, which may include and/or be a modified dump bailer 108. Similar to the illustrative, non-exclusive examples of sealing apparatus that are discussed in more detail herein with reference to FIGS. 4-8, any suitable component, element, and/or feature of the sealing apparatus of FIG. 9 may be incorporated into any sealing apparatus 100 that is disclosed herein without departing from the scope of the present disclosure.

In FIG. 9, sealing apparatus 100 includes a delivery structure 150. A portion of delivery structure 150 is defined by a tube 200, which also may be referred to herein as a metallic tube 200. Tube 200 includes an uphole end 104 and a downhole end 102 and retains charge of sealing material 170 (including secondary sealing agent 180) therein during conveyance of sealing apparatus 100 from surface region 40 to within threshold distance 110 of the perforations 64 (as illustrated in FIG. 1). Delivery structure 150 further includes a closure 144, in the form of a frangible material 162, such as a window 208, which is operatively attached to downhole end 102 of metallic tube 200, and a retention structure 212, which is located uphole from charge of sealing material 170 and is configured to retain the charge of sealing material within metallic tube 200. Thus, metallic tube 200, window 208, and retention structure 212 cooperate to define internal chamber 160. Metallic tube 200 may include an inflow port 166, which also may be referred to herein as a side opening 166, that may provide for fluid flow therethrough, and retention structure 212 may define an orifice 216, which also may provide for fluid flow therethrough.

Sealing apparatus 100 further includes release mechanism 140, in the form of an explosive device 148, which is configured to selectively supply the fracture stress to frangible material 162 to thereby break apart and/or destroy the frangible material, remove window 208 from delivery structure 150, and/or release charge of sealing material 170 from the sealing apparatus. Upon destruction of frangible material 162, fluid 38 may flow into inflow port 166, through orifice 216, and into charge of sealing material 170, thereby flushing, flowing, and/or otherwise urging the charge of sealing material from internal chamber 160.

Retention structure 212 may be retained within sealing apparatus 100 by pins (or other suitable retainers and/or fasteners) 220, which may limit motion of retention structure 212 toward uphole end 104 of the sealing apparatus but may provide for motion of retention structure 212 toward downhole end 102 of the sealing apparatus. Thus, and subsequent to destruction of frangible material 162, retention structure 212 may flow with fluid 38 toward downhole end 102 of the sealing apparatus, further urging charge of sealing material 170 therefrom. It is within the scope of the present disclosure that retention structure 212 may include a monolithic retention structure. However, it is also within the scope of the present disclosure that retention structure 212 may include a composite retention structure, a plurality of components, and/or a segmented retention structure that is configured to break apart upon destruction of frangible material 162, further increasing a flow of fluid 38 through internal chamber 160.

Figure 10:
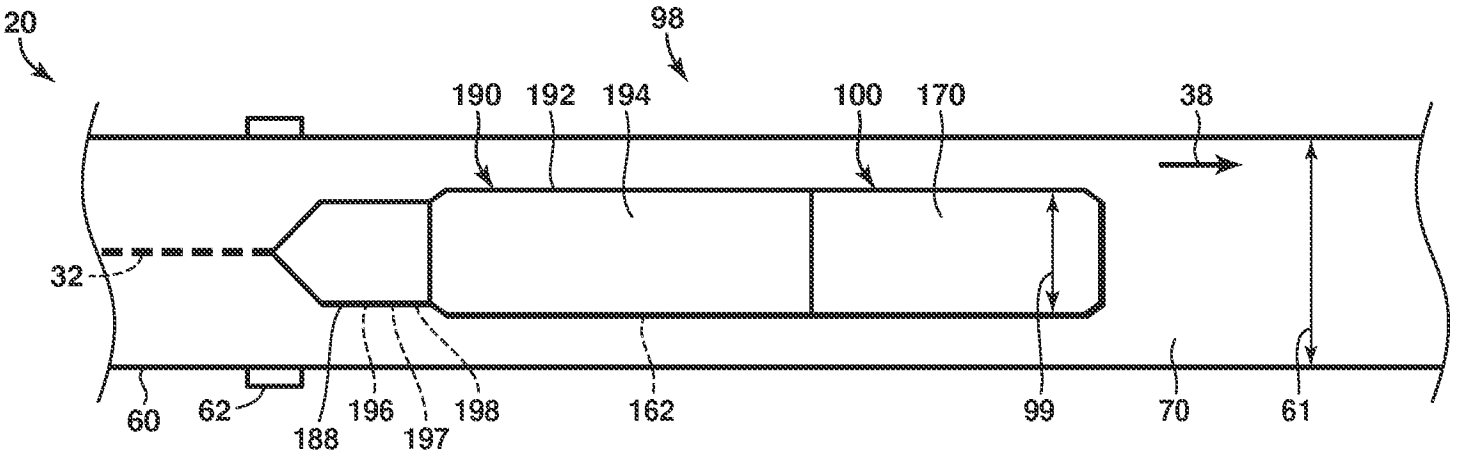
FIG. 10 is a schematic representation of illustrative, non-exclusive examples of a completion assembly that includes a sealing apparatus according to the present disclosure.
Figure 11:
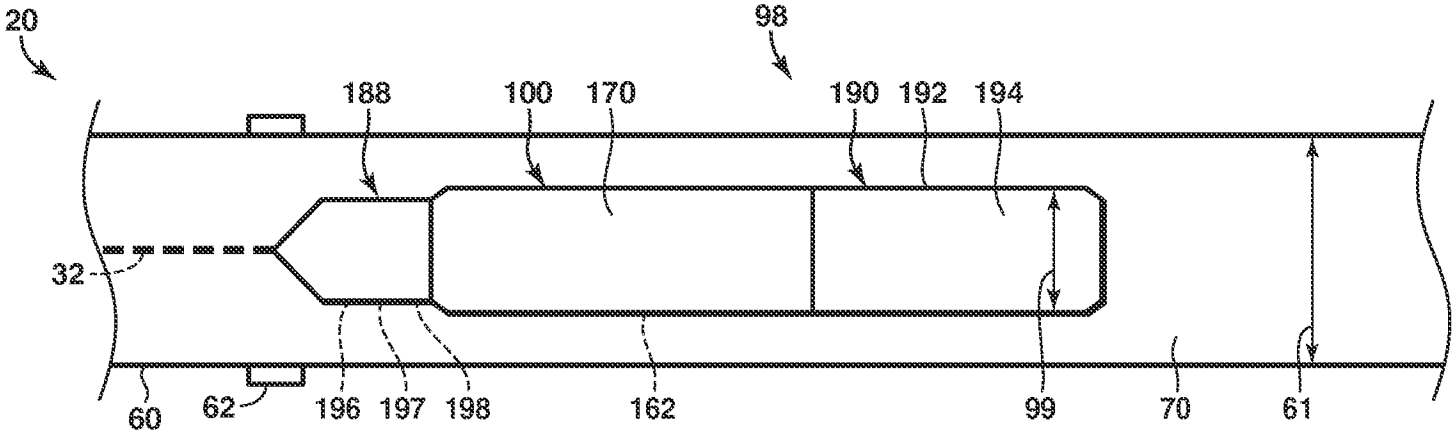
FIG. 11 is another schematic representation of illustrative, non-exclusive examples of a completion assembly that includes a sealing apparatus according to the present disclosure.

FIGS. 10-11 are schematic representations of illustrative, non-exclusive examples of a completion assembly 98 that includes a sealing apparatus 100 according to the present disclosure and which may be located within a casing conduit 70. Completion assemblies 98 further include a perforation device 190, such as a perforation gun 192, which may include a plurality of perforation charges 194, and/or a casing collar locator 188, which is configured to determine a location of the completion assembly within casing conduit 70 by detecting when the completion assembly passes a casing collar 62 that is associated with wellbore casing 60 that defines casing conduit 70. The completion assembly may be operatively attached to, in mechanical and/or electrical communication with, and/or may include a working line 32, which may include a slickline, a wireline, and/or an electric line, and may provide mechanical and/or electrical communication between the completion assembly and an uphole portion of well 20, such as surface region 40 (as illustrated in FIG. 1).

In FIG. 10, sealing apparatus 100 is illustrated as being downhole from perforation device 190. When sealing apparatus 100 is downhole from perforation device 190, and as discussed in more detail herein, charge of sealing material 170 may be released from completion assembly 98 at and/or near a downhole end thereof. As such, the charge of sealing materials may be conveyed downhole from the completion assembly by flow of fluid 38 without passing by the completion assembly (or at least the uphole portion thereof). Thus, the charge of sealing material may include one or more components that include a characteristic dimension that is greater than a difference between an inner diameter 61 of wellbore casing 60 and an outer diameter 99 of completion assembly 98, which may provide more flexibility in the selection of the components of charge of sealing material 170.

In contrast, FIG. 11 illustrates a completion assembly 98 in which sealing apparatus 100 is located uphole from perforation device 190. When sealing apparatus 100 is located uphole from perforation device 190, it may be less likely to be damaged by perforation device 190 during operation thereof. However, and as discussed in more detail herein, a characteristic dimension of the components of charge of sealing material 170 may be constrained, such as to a characteristic dimension that is less than the difference between inner diameter 61 of wellbore casing 60 and outer diameter 99 of completion assembly 98.

Alternatively, and as indicated in dashed lines in FIG. 11, completion assembly 98 may be formed from frangible material 162. When the completion assembly is formed from the frangible material, destruction of the completion assembly may decrease, or even eliminate, the constraint on the characteristic dimension of the components of charge of sealing material 170 since the completion assembly may break apart (potentially into granular and/or particulate form) within casing conduit 70, thereby decreasing and/or eliminating outer diameter 99 thereof. This may provide for use of a completion assembly that includes a larger outer diameter than an outer diameter of a comparable completion assembly that is not constructed from frangible material 162. For example, and with reference to FIGS. 10 and 11, when completion assembly 98 is formed from frangible material 162, a characteristic dimension of a primary sealing agent that may be supplied to casing conduit 70 uphole from the completion assembly and may be conveyed past the completion assembly subsequent to destruction thereof may not be constrained by outer diameter 99.

Whether completion assembly 98 includes sealing apparatus 100 downhole from perforation device 190 (as illustrated in FIG. 10) or uphole from perforation device 190 (as illustrated in FIG. 11), charge of sealing material 170 may be located near and/or proximal to perforation device 190 within casing conduit 70, thereby providing for rapid, effective, efficient, and/or accurate conveyance of the charge of sealing material to perforations that may be present within the wellbore casing and/or created by perforation device 190. This may improve the overall efficiency of a completion operation that utilizes completion assembly 98.

It is within the scope of the present disclosure that, as shown in dashed lines in FIGS. 10-11 and discussed herein, working line 32 may provide mechanical and/or electrical communication between completion assembly 98 and an uphole portion of casing conduit 70 and/or between the completion assembly and surface region 40. However, it is also within the scope of the present disclosure that completion assembly 98 may not include and/or be attached to working line 32. When completion assembly 98 is not attached to working line 32, completion assembly 98 also may be referred to herein as an autonomous completion assembly 98. Illustrative, non-exclusive examples of autonomous completion assemblies are disclosed in U.S. Provisional Patent Application No. 61/348,578 and any non-provisional applications thereof, as well as PCT Patent Application Nos. PCT/US2011/031948 and PCT/US2011/038202, the complete disclosures of which are hereby incorporated by reference.

Autonomous completion assemblies may include one or more components, such as a controller 196, a depth detector 197, and/or a position detector 198, that may be configured to control and/or provide for actuation of perforation device 190 (such as to produce one or more perforations within wellbore casing 60) and/or sealing apparatus 100 (such as to release charge of sealing material 170 therefrom to seal the perforations) without a physical connection between the autonomous completion assembly and surface region 40. As an illustrative, non-exclusive example, the autonomous completion assembly may be configured to form one or more new perforations within wellbore casing 60 and seal one or more perforations within wellbore 60 without the physical connection between the autonomous completion assembly and the surface region and/or without being removed from casing conduit 70 subsequent to formation of the perforations and/or release of the charge of sealing material. As another illustrative, non-exclusive example, the autonomous completion assembly may be configured to self destruct while present within casing conduit 70 (such as when the autonomous completion assembly is formed at least partially from a frangible material 162), and the destruction of the autonomous completion assembly may produce charge of sealing material 170 and/or secondary sealing agent 180.

Figure 12:
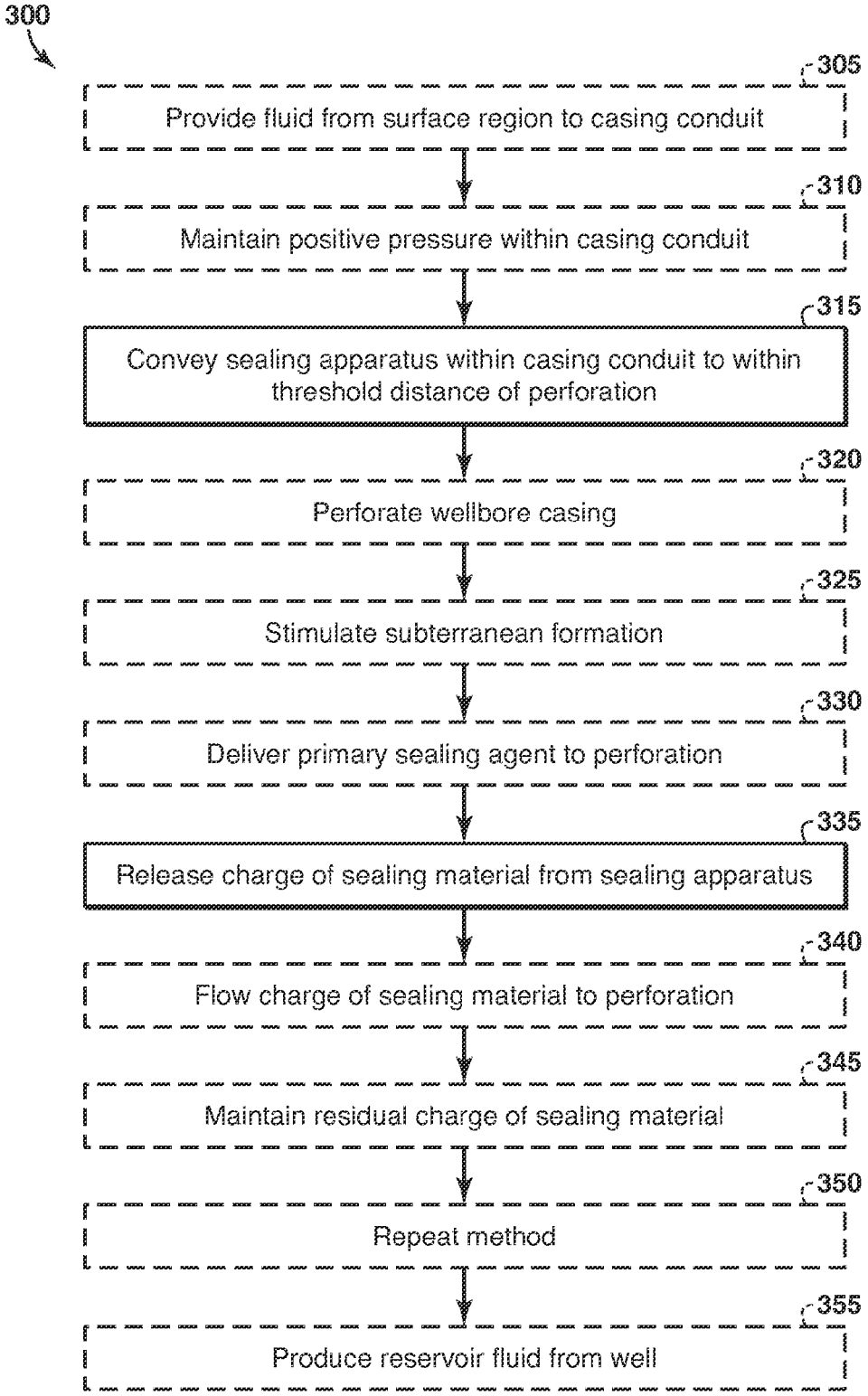
FIG. 12 is a flowchart depicting methods according to the present disclosure of providing a secondary sealing agent to a perforation within a casing conduit.

FIG. 12 is a flowchart depicting methods 300 according to the present disclosure of providing a secondary sealing agent to a perforation. The perforation may be present within a wellbore casing that defines a casing conduit and which extends between a surface region and a subterranean formation. The perforation may be associated with a primary sealing agent that partially blocks a flow of a fluid from the casing conduit through the perforation. The methods may provide at least the secondary sealing agent to supplement, or enhance, a seal formed by a primary sealing agent and/or decrease a flow rate of fluid from the casing conduit through the perforation.

Methods 300 may include providing the fluid from the surface region into the casing conduit at 305 and maintaining a positive pressure within the casing conduit at 310. The methods include conveying a sealing apparatus within the casing conduit to within a threshold distance of the perforation at 315 and further may include perforating the wellbore casing to create the perforation at 320, stimulating the subterranean formation at 325, and/or delivering the primary sealing agent to the perforation at 330. The methods further include releasing a charge of sealing material that includes the secondary sealing agent from the sealing apparatus at 335 and may include flowing the charge of sealing material to the perforation at 340, maintaining a residual charge of sealing material within the casing conduit at 345, repeating the method at 350, and/or producing reservoir fluid from a well that includes the wellbore at 355.

Providing the fluid from the surface region to the casing conduit at 305 may include the use of any suitable structure to provide, supply and/or convey the fluid from, or from proximal to, the surface region into the casing conduit at a supply flow rate. It is within the scope of the present disclosure that providing the fluid may include providing the fluid simultaneously with at least a portion of a remainder of the method. Illustrative, non-exclusive examples of the portion of the remainder of the method include at least 50%, at least 60%, at least 70%, at least 80%, at least 90%, or at least 100% of a time period during which the method is being performed. As more specific but still illustrative, non-exclusive examples, the providing may occur, or continue to occur, during at least the maintaining at 310, the stimulating at 325, the delivering at 330, the releasing at 335, the flowing at 340, and the maintaining at 345 and optionally may occur during the conveying at 325, the perforating at 320, and/or the repeating at 350.

Maintaining a positive pressure within the casing conduit at 310 may include the use of any suitable structure to maintain the positive pressure during any suitable portion of the method. This may include maintaining a pressure within the casing conduit to be greater than a pressure in a region of the subterranean formation that is external to and/or proximal to the casing conduit. As an illustrative, non-exclusive example, the maintaining may be accomplished, at least in part, by the providing at 305. As another illustrative, non-exclusive example, the maintaining may be accomplished, at least in part, by the primary sealing agent, the secondary sealing agent, and/or the charge of sealing material. Illustrative, non-exclusive examples of the portion of the method include at least 50%, at least 60%, at least 70%, at least 80%, at least 90%, or at least 100% of the time period during which the method is being performed. As more specific but still illustrative, non-exclusive examples, the maintaining may occur, or continue to occur, during at least the providing at 305, the stimulating at 325, the delivering at 330, the releasing at 335, the flowing at 340, and the maintaining at 345 and optionally may occur during the conveying at 325, the perforating at 320, and/or the repeating at 350.

Conveying the sealing apparatus within the casing conduit and to within the threshold distance of the perforation at 315 may include moving the sealing apparatus within the casing conduit in an uphole and/or a downhole direction, with illustrative, non-exclusive examples of the threshold distance being discussed in more detail herein. As an illustrative, non-exclusive example, the conveying may include conveying the sealing apparatus from the surface region and/or from a region that is external to the casing conduit. As another illustrative, non-exclusive example, the conveying may include conveying the sealing apparatus to a horizontal portion of the wellbore such that the releasing at 335 may be performed within the horizontal portion of the wellbore. As another illustrative, non-exclusive example, the conveying may include conveying the sealing apparatus to a region, or portion, of the wellbore casing that is to be perforated.

It is within the scope of the present disclosure that the conveying may be accomplished in any suitable manner. As an illustrative, non-exclusive example, the conveying may include pumping the sealing apparatus through the casing conduit with a fluid stream, such as the fluid that is provided at 305.

As another illustrative, non-exclusive example, the conveying further may include locating the sealing apparatus within a target portion, or region, of the casing conduit. It is within the scope of the present disclosure that the locating may be at least substantially similar to the conveying. However, it is also within the scope of the present disclosure that the conveying may include conveying the sealing apparatus to a roughly, or generally, defined location within the casing conduit, with the locating being utilized to more finely position the sealing apparatus within the casing conduit. As an illustrative, non-exclusive example, the locating may include detecting a location of the sealing apparatus within the casing conduit. As another illustrative, non-exclusive example, the locating may include locating the sealing apparatus and/or adjusting a position of the sealing apparatus with a working line, with a slickline, with a wireline, with an electric line, with a tractor, with a position detector, and/or with a depth control device. As used herein, locating the sealing apparatus within the target portion, or region, of the casing conduit additionally or alternatively may be referred to as positioning and/or aligning the sealing apparatus within and/or relative to the target portion, or region, of the casing conduit.

Perforating the wellbore casing at 320 may include the use of any suitable structure, such as a perforation device and/or a perforation gun, to create the perforation within the wellbore casing. When the method includes perforating the wellbore casing, it is within the scope of the present disclosure that, as discussed in more detail herein, the conveying may include conveying the sealing apparatus to a region of the wellbore casing that is to be perforated such that, subsequent to the perforation, the sealing apparatus will be within the threshold distance of the perforation.

Stimulating the subterranean formation at 325 may include providing a stimulant fluid through the perforation and into the subterranean formation. The stimulating may be performed prior to delivering the primary sealing agent to the perforation at 330 and/or prior to releasing the (retained) charge of sealing material from the sealing apparatus at 335. Illustrative, non-exclusive examples of stimulant fluids according to the present disclosure are discussed in more detail herein.

Delivering the primary sealing agent to the perforation at 330 may include delivering any suitable primary sealing agent, including the primary sealing agents that are discussed in more detail herein, to the perforation to at least partially seal and/or block the perforation and/or to decrease the flow of fluid therethrough. It is within the scope of the present disclosure that delivering the primary sealing agent to the perforation may be performed and/or accomplished prior to releasing the charge of sealing material from the sealing apparatus at 335 and/or prior to the secondary sealing agent being delivered to the perforation, which may provide for cooperative sealing of the perforation by both the primary sealing agent and the secondary sealing agent. Additionally or alternatively, it is also within the scope of the present disclosure that delivering the primary sealing agent at 330 may include retaining the primary sealing agent at, on, and/or near the perforation to decrease the fluid flow therethrough prior to retaining the secondary sealing agent at, on, and/or near the perforation and/or between the primary sealing agent and the wellbore casing, which may once again provide for cooperative sealing of the perforation by both the primary sealing agent and the secondary sealing agent.

Releasing the charge of sealing material from the sealing apparatus at 335 may include releasing the charge of sealing material after the sealing apparatus is within the threshold distance of the perforation. In other words, the charge of sealing material may be conveyed with and/or within the sealing apparatus to the target region, or portion, of the casing conduit and thereafter produced, dispensed, dispersed, and/or otherwise released from the sealing apparatus. This includes releasing the secondary sealing agent, which may flow within the casing conduit to the perforation, such as to supplement the primary sealing agent (and/or a primary seal that is formed thereby) and/or decrease a flow rate of fluid from the casing conduit through the perforation. While methods 300 may refer to a single perforation, it is within the scope of the present disclosure that the releasing may include releasing the charge of sealing material to supplement a plurality of seals that may be present between a plurality of perforations and a plurality of respective primary sealing agents.

Additionally or alternatively, releasing the charge of sealing material also may include releasing the charge of sealing material responsive to, or responsive to the occurrence of, an event and/or trigger. Illustrative, non-exclusive examples of events and/or triggers according to the present disclosure include a wellbore pressure that is less than a wellbore pressure threshold, detecting that the wellbore pressure is less than the wellbore pressure threshold, a decrease in the wellbore pressure that is greater than a threshold wellbore pressure decrease, and/or detecting the decrease in the wellbore pressure that is greater than the threshold wellbore pressure decrease. It is within the scope of the present disclosure that the threshold wellbore pressure and/or the threshold wellbore pressure decrease may include a fixed and/or predetermined value. However, it is also within the scope of the present disclosure that, when the method includes providing the fluid at 305, the threshold wellbore pressure and/or the threshold wellbore pressure decrease may be based, at least in part, on the supply flow rate of the fluid. Additionally or alternatively, it is also within the scope of the present disclosure that the event and/or trigger includes the supply flow rate of the fluid exceeding a threshold supply flow rate, detecting that the supply flow rate has exceeded the threshold supply flow rate, the flow of the fluid from the casing conduit and through the perforation exceeding a threshold flow rate, and/or detecting that the flow of the fluid from the casing conduit through the perforation has exceeded the threshold flow rate.

Another illustrative, non-exclusive example of events and/or triggers according to the present disclosure includes perforating the wellbore casing at 320. As an illustrative, non-exclusive example, releasing the charge of sealing material at 335 may be performed prior to the perforating, concurrently with the perforating, and/or subsequent to the perforating. As another illustrative, non-exclusive example, and when the perforation device includes a perforation gun that includes a predetermined quantity of perforation charges, the event and/or trigger may include depletion of the perforation device, such as through use of all of the perforation charges thereof, and/or detecting that the perforation device has been depleted.

Yet another illustrative, non-exclusive example of events and/or triggers according to the present disclosure may be based, at least in part, on motion, or expected motion, of the perforation device within the casing conduit. As illustrative, non-exclusive examples, the events and/or triggers may include determining that the perforation device is to be removed from the casing conduit, initiating removal of the perforation device from the casing conduit, removing the perforation device from the casing conduit, abandoning the perforation device within the casing conduit, and/or destroying the perforation device within the casing conduit.

It is within the scope of the present disclosure that the releasing may include releasing using any suitable mechanism. As an illustrative, non-exclusive example, and when the sealing apparatus includes a frangible material, the releasing may include breaking apart, disintegrating, and/or destroying at least a portion of the sealing apparatus that includes the frangible material, with illustrative, non-exclusive examples of portions of the sealing apparatus that may include the frangible material being discussed in more detail herein. When the releasing includes destroying a portion of the sealing apparatus, it is within the scope of the present disclosure that the destroying may generate a portion and/or all of the charge of sealing material, with illustrative, non-exclusive examples of the portion of the charge of sealing material being discussed in more detail herein. Additionally or alternatively, the releasing may include detonating a charge that is configured to release the charge of sealing material from the sealing apparatus, destroying a portion and/or all of the sealing apparatus to provide a pathway, or conduit, for flow of the charge of sealing material from the apparatus, providing an electrical signal to an electrical actuator to release the charge of sealing material from the sealing apparatus, and/or mechanically actuating a mechanical actuator to release the charge of sealing material from the sealing apparatus.

As discussed, the charge of sealing material may define a release concentration while it is retained within the sealing apparatus. It is within the scope of the present disclosure that the releasing may include releasing the charge of sealing material and/or conveying, flowing, and/or otherwise providing the charge of sealing material from the sealing apparatus and to the perforation such that a delivery concentration of the sealing material when the sealing material reaches the perforation may be at least 5%, at least 10%, at least 15%, at least 20%, at least 25%, at least 30%, at least 40%, or at least 50% of the release concentration.

As also discussed, the charge of sealing material may include the secondary sealing agent, which may be configured to cooperate with and/or supplement the primary sealing agent and to decrease the flow of fluid from the casing conduit through the perforation. The secondary sealing agent may be sized, constructed, and/or configured such that the secondary sealing agent may be ineffective at decreasing the flow of fluid through the perforation if the primary sealing agent is not already present at the perforation. Thus, the releasing may include delivering the secondary sealing agent to the perforation subsequent to and/or after the primary sealing agent is already present at the perforation and/or is already partially blocking the flow of the fluid through the perforation. Additionally or alternatively, the releasing also may include releasing a sufficient volume of the secondary sealing agent to effectively supplement the primary sealing agent and/or to at least substantially seal the perforation and/or block the flow of fluid therethrough.

Regardless of how and/or why the charge of sealing material is released from the sealing apparatus, the charge of sealing material may be selected, designed, configured, and/or sized to decrease the flow rate of the fluid from the casing conduit and through the perforation by at least a threshold percentage of the flow rate of the fluid prior to the releasing. Illustrative, non-exclusive examples of threshold percentages according to the present disclosure include threshold percentages of at least 30%, at least 40%, at least 50%, at least 60%, at least 70%, at least 80%, at least 90%, at least 95%, or 100%.

Flowing the charge of sealing material to the perforation at 340 may include entraining the charge of sealing material within the fluid that is present within the casing conduit to convey and/or flow the charge of sealing material to the perforation. It is within the scope of the present disclosure that the flowing may include supplying and/or providing the fluid to the casing conduit at the supply flow rate, such as is discussed in more detail herein with reference to the providing at 305.

Maintaining the residual charge of sealing material within the casing conduit at 345 may include the use of any suitable mechanism to maintain the residual charge of sealing material, which may include the secondary sealing agent, subsequent to the releasing. Such maintaining may provide for sealing of leaks that may occur subsequent to the releasing and/or after delivery of the secondary sealing agent to the perforation.

As illustrative, non-exclusive examples, the maintaining may include maintaining the residual charge in a region of the casing conduit that is proximal to the perforation, suspending the residual charge of sealing material within the casing conduit (such as by constructing and/or selecting the charge of sealing material so that it is at least substantially neutrally buoyant within the fluid that is present within the casing conduit), accumulating the residual charge of sealing material throughout at least a portion of the casing conduit (such as throughout a portion of the casing conduit that includes perforations), and/or replacing the residual charge of sealing material as it is depleted from the casing conduit and/or from the fluid that is present within the casing conduit (such as by repeating the releasing and/or releasing additional secondary sealing agent to maintain the residual charge of sealing material).

Additionally or alternatively, maintaining the residual charge of sealing material within the casing conduit also may include placing, locating, and/or affixing one or more sealing apparatus at one or more predetermined locations within the casing conduit, thereby providing for release of a charge of sealing material that is retained therein at any suitable time and/or responsive to any suitable criteria. As an illustrative, non-exclusive example, the sealing apparatus may be affixed to an inner wall of the wellbore casing and may be configured to release the charge of sealing material responsive to any suitable event and/or trigger, including those that are discussed in more detail herein.

Repeating the method at 350 may include repeating any suitable portion of the method to create and/or seal any suitable perforation within the wellbore casing. It is within the scope of the present disclosure that, as discussed in more detail herein, the sealing apparatus may include a plurality of charges of sealing material and/or that the perforation device may include a plurality of perforation charges. As such, the repeating may include repeating the method without removing the sealing apparatus from the casing conduit and/or repeating the method at least a threshold number of times prior to removing the sealing apparatus from the casing conduit. Illustrative, non-exclusive examples of the threshold number of times include at least 2, at least 3, at least 4, at least 5, at least 6, at least 7, at least 8, at least 9, at least 10, at least 12, or at least 15 times.

As an illustrative, non-exclusive example, the method may include conveying the sealing apparatus to a first location within the casing conduit prior to the releasing and/or the perforating, and the repeating may include conveying the sealing apparatus to a second location within the casing conduit that is different and/or uphole from the first location prior to repeating at least the releasing and/or the perforating. When the repeating includes repeating the perforating, it is within the scope of the present disclosure that the repeating may include perforating a plurality of portions of the wellbore casing to create a plurality of perforations and/or stimulating a plurality of portions of the subterranean formation that are proximal to the plurality of perforations. It is also within the scope of the present disclosure that the perforating and/or the stimulating may be performed without fluidly isolating an uphole portion of the casing conduit from a downhole portion of the casing conduit, such as through the use of a plug and/or packer, which also may be referred to herein as plugless completion of the well. Illustrative, non-exclusive examples of the plurality of perforations, the plurality of portions of the wellbore casing, and/or the plurality of portions of the subterranean formation include at least 5, at least 10, at least 20, at least 30, at least 40, at least 50, at least 60, at least 70, at least 80, at least 90, or at least 100.

Producing the reservoir fluid from the well at 355 may include the use of any suitable system and/or method to remove the wellbore fluid from the subterranean formation, flow the reservoir fluid through the casing conduit, and/or relocate the wellbore fluid to the surface region. It is within the scope of the present disclosure that at least the conveying at 315 and the releasing at 335 may be performed as part of a wellbore stimulation operation and that the method further may include transitioning the well from the wellbore stimulation operation to the producing.

The transitioning may include transitioning from the wellbore stimulation operation (which also may be referred to herein as a plugless wellbore stimulation operation) to the producing without removing a plug from the casing conduit, producing reservoir fluid from an entire length of the casing conduit, and/or flowing reservoir fluid through the entire length of the casing conduit and to the surface region. The transitioning also may include drawing a fluid through the perforation and into the casing conduit from the subterranean formation, and/or removing the primary sealing agent and/or the secondary sealing agent from the perforation while drawing the fluid through the perforation.

It is within the scope of the present disclosure that, when the wellbore casing includes a plurality of perforations that are associated with a respective plurality of primary and/or secondary sealing agents, the transitioning may include removing the respective primary and/or secondary sealing agents from at least a portion of the plurality of perforations and/or simultaneously removing from the portion of the plurality of perforations. Illustrative, non-exclusive examples of the portion of the plurality of perforations include at least 20%, at least 30%, at least 40%, at least 50%, at least 60%, at least 70%, at least 80%, at least 90%, at least 95%, or all of the plurality of perforations.

Figure 13:
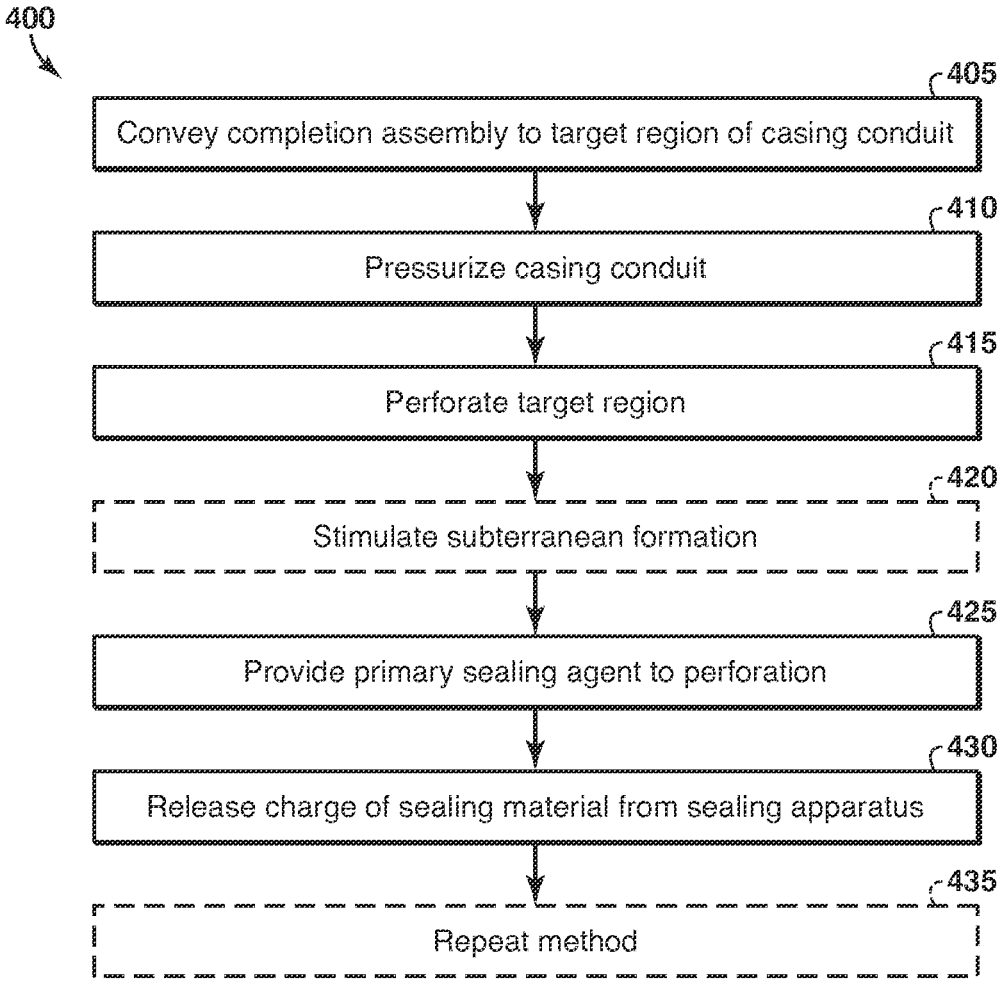
FIG. 13 is a flowchart depicting methods according to the present disclosure of completing a hydrocarbon well.

FIG. 13 is a flowchart depicting methods 400 according to the present disclosure of completing a hydrocarbon well that includes a wellbore that extends between a surface region and a subterranean formation, and a wellbore casing that defines a casing conduit and is present within the wellbore. The methods include conveying a completion assembly that includes sealing apparatus and a perforation device to a target region of a casing conduit at 405, pressurizing the casing conduit relative to the wellbore with a fluid at 410, and perforating the target region of the casing conduit to create a perforation that releases the fluid from the casing conduit and into the wellbore at 415. The methods further may include stimulating the subterranean formation at 420 and providing a primary sealing agent to the perforation to decrease a flow rate of the fluid from the casing conduit and through the perforation at 425. The methods further include releasing a charge of sealing material that includes a secondary sealing agent from the sealing apparatus to supplement the primary sealing agent and further decrease the flow rate of the fluid through the perforation at 430. The methods may include repeating the method at 435.

Conveying the completion assembly to the target region of the casing conduit at 405 may include moving, flowing, and/or locating the completion assembly within any suitable target region of the casing conduit, such as a region of the casing conduit that is to be perforated, stimulated, and/or sealed. Illustrative, non-exclusive examples of conveying according to the present disclosure are discussed in more detail herein with reference to methods 300.

Pressurizing the casing conduit at 410 may include providing the fluid to the casing conduit, such as from the surface region. It is within the scope of the present disclosure that the providing may include continuously, or at least substantially continuously, providing the fluid to the casing conduit. Alternatively, it is also within the scope of the present disclosure that the providing may include intermittently providing the fluid to the casing conduit. It is further within the scope of the present disclosure that the providing may include flowing the fluid in contact with an inner surface of the wellbore casing for at least a portion of a distance from the surface region to the perforation. Illustrative, non-exclusive examples of the portion of the distance from the surface region to the perforation include at least a majority, at least 50%, at least 60%, at least 70%, at least 80%, at least 90%, at least 95%, or at least 99% of the distance from the surface region to the perforation.

Perforating the target region of the casing conduit at 415 may include the use of any suitable perforation device to create any suitable number of perforations, such as 1, at least 2, at least 3, at least 4, at least 5, at least 6, at least 7, at least 8, at least 9, at least 10 perforations, or at least 12 perforations in the target region of the casing conduit. As an illustrative, non-exclusive example, the perforating may include discharging one or more perforation charges from one or more perforation guns of the perforation device.

Stimulating the subterranean formation at 420 may include providing a stimulant fluid from the casing conduit, through the perforation, and into the subterranean formation for a stimulation time prior to providing the primary sealing agent at 425 and/or releasing the charge of sealing material that includes the secondary sealing agent at 430. Illustrative, non-exclusive examples of stimulant fluids according to the present disclosure are discussed in more detail herein.

Providing the primary sealing agent to the perforation at 425 may include providing the primary sealing agent in any suitable manner. As an illustrative, non-exclusive example, the providing may include supplying the primary sealing agent to the casing conduit, such as from the surface region, flowing the primary sealing agent through the casing conduit to the perforation, and/or flowing the primary sealing agent past the completion assembly to the perforation. As another illustrative, non-exclusive example, and as discussed herein, the providing may include releasing the primary sealing agent from the sealing apparatus. It is within the scope of the present disclosure that the charge of sealing material may include the primary sealing agent and/or that the primary sealing agent may be separate from the charge of sealing material, such as by being contained within a different delivery structure of the sealing apparatus and/or in a different sealing apparatus than the charge of sealing material.

Releasing the charge of sealing material at 430, which as discussed includes at least releasing the secondary sealing agent, may include releasing the charge of sealing material responsive to any suitable event and/or trigger, such as those that are discussed in more detail herein with reference to methods 300. This may include releasing the charge of sealing material independently from the perforating, prior to the perforating, subsequent to the perforating, not directly responsive to the perforating, and/or based, at least in part, on the perforating and/or on passage of a threshold elapsed time subsequent to the perforating. Additionally or alternatively, the releasing also may include releasing the charge of sealing material subsequent to providing the primary sealing agent and/or subsequent to at least partially sealing the perforation with the primary sealing agent.

Repeating the method at 435 may include repeating any suitable portion of the method to complete, stimulate, and/or seal any suitable additional target portion, or region, of the well and/or of the subterranean formation. As an illustrative, non-exclusive example, the target region may be a first target region and the repeating may include repeating the method in a second target region that is different and/or uphole from the first target region. It is within the scope of the present disclosure that the repeating may include creating any suitable number of perforations in any suitable number of target portions of the wellbore casing and/or stimulating any suitable number of target regions of the subterranean formation. This may include at least 10, at least 20, at least 30, at least 40, at least 50, at least 60, at least 70, at least 80, at least 90, or at least 100 perforations, target portions of the wellbore casing, and/or target regions of the subterranean formation.

The method further may include maintaining the pressurizing at 410 during at least a portion of the method and/or during the repeating. Illustrative, non-exclusive examples of the portion of the method are discussed in more detail herein with reference to methods 300.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices, such as a controller. The illustrated blocks may, but are not required to, represent executable instructions that cause a computer, processor, controller, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, sized, implemented, utilized, programmed, and/or designed for the purpose of performing the function. It is within the scope of the present disclosure that elements, components, and/or other recited subject matter that is recited as being adapted to perform a particular function may additionally or alternatively be described as being configured to perform that function, and vice versa. It is also within the scope of the present disclosure that any system, component, and/or element that is disclosed herein as performing an action also may be described as being adapted, configured, selected, created, sized, implemented, utilized, programmed, and/or designed to perform the action.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of providing a secondary sealing agent to a perforation, wherein the perforation is present within a wellbore casing that defines a casing conduit in which a primary sealing agent partially blocks a flow of a fluid from the casing conduit through the perforation, the method comprising:

conveying a sealing apparatus within the casing conduit to within a threshold distance of the perforation, wherein the sealing apparatus retains a charge of sealing material that includes the secondary sealing agent;

wherein at least a portion of the sealing apparatus is formed from a frangible material that when destructed the frangible material forms a portion of the charge of sealing material and releasing the charge of sealing material from the sealing apparatus to deliver the secondary sealing agent to the perforation to supplement the primary sealing agent and decrease a flow rate of the fluid from the casing conduit through the perforation.

2. The method of claim 1, wherein the releasing includes releasing the charge of sealing material after the sealing apparatus is within the threshold distance of the perforation.

3. The method of claim 1, wherein the threshold distance is less than 50 meters.

4. The method of claim 1, wherein the releasing includes destroying at least a portion of the sealing apparatus to generate a portion of the charge of sealing material.

5. The method of claim 1, wherein the charge of sealing material defines a release concentration of at least 30% by volume solids while the charge of sealing material is retained within the sealing apparatus.

6. The method of claim 1, wherein the method further includes perforating the wellbore casing with a perforation device to create the perforation.

7. The method of claim 1, wherein the method further includes maintaining a residual charge of the secondary sealing agent within the casing conduit subsequent to the releasing.

8. The method of claim 1, wherein the releasing further includes releasing at least one of (i) the primary sealing agent and (ii) a supplemental material, from the sealing apparatus.

9. The method of claim 1, wherein the conveying includes conveying the sealing apparatus to a first location within the casing conduit prior to the releasing, and further wherein the method includes conveying the sealing apparatus to a second location within the casing conduit that is different from the first location and repeating the releasing.

10. The method of claim 1, wherein the method further includes perforating the wellbore casing with a perforation device to create the perforation, wherein the perforation is a first perforation, and further wherein the method includes repeating the perforating to create a second perforation with the perforation device.

11. The method of claim 1, wherein the method further includes producing a reservoir fluid from a well that includes the wellbore, wherein at least the conveying and the releasing are performed as part of a wellbore stimulation operation, and further wherein the method includes transitioning from the wellbore stimulation operation to the producing without removing a plug from the casing conduit.

12. The method of claim 11, wherein the transitioning includes drawing the fluid through the perforation and into the casing conduit to remove the primary sealing agent and the secondary sealing agent from the perforation.

13. The method of claim 1, wherein the method further includes retaining the primary sealing agent at the perforation prior to retaining the secondary sealing agent at the perforation.

14. The method of claim 1, wherein the primary sealing agent includes a characteristic dimension, wherein the secondary sealing agent includes a characteristic dimension, wherein the perforation includes a characteristic dimension, wherein the characteristic dimension of the primary sealing agent is greater than the characteristic dimension of the secondary sealing agent, wherein the characteristic dimension of the primary sealing agent is greater than the characteristic dimension of the perforation, and further wherein the characteristic dimension of the secondary sealing agent is less than the characteristic dimension of the perforation.

15. A method of completing a hydrocarbon well that includes a wellbore that extends between a surface region and a subterranean formation and a wellbore casing that defines a casing conduit, the method comprising: conveying a completion assembly to a target region of the casing conduit, wherein the completion assembly includes a perforation device and a sealing apparatus, wherein the sealing apparatus retains the charge of sealing material within the sealing apparatus, wherein the charge of sealing material includes a secondary sealing agent;

pressurizing the casing conduit relative to the wellbore with a fluid; perforating the target region with the perforation device to create a perforation that releases the fluid from the casing conduit into the wellbore to stimulate a portion of the subterranean formation;

providing a primary sealing agent to the perforation to decrease a flow rate of the fluid from the casing conduit through the perforation; and releasing the charge of sealing material from the sealing apparatus structure to supplement the primary sealing agent with the secondary sealing agent and further decrease the flow rate of the fluid through the perforation, and wherein at least a portion of the sealing apparatus is formed from a frangible material that when destructed the frangible material forms a portion of the charge of sealing material.

16. The method of claim 15, wherein the pressurizing includes providing the fluid to the casing conduit from the surface region.

17. The method of claim 15, wherein providing the primary sealing agent includes supplying the primary sealing agent to the casing conduit and flowing the primary sealing agent through the casing conduit to the perforation.

18. The method of claim 15, wherein providing the primary sealing agent includes releasing the primary sealing agent from the sealing apparatus, wherein the primary sealing agent forms a portion of the charge of sealing material.

19. The method of claim 15, wherein the releasing is independent of the perforating.

20. The method of claim 15, wherein the method further includes stimulating the portion of the subterranean formation with the fluid, wherein the stimulating is subsequent to the perforating, and further wherein the stimulating includes stimulating for a stimulation time prior to the providing the primary sealing agent.

21. The method of claim 15, wherein the target region is a first target region, and further wherein the method includes repeating the method in a second target region that is different from the first target region.

22. The method of claim 15, wherein the perforating includes perforating a plurality of target regions to create at least one perforation in each of the plurality of target regions, and further wherein the releasing is performed subsequent to perforating the plurality of target regions.

23. The method of claim 22, wherein, subsequent to the releasing, the method further includes removing the completion assembly from the casing conduit, replenishing at least one of the perforation device and the sealing apparatus, reinserting the completion assembly into the casing conduit, and repeating the method.

24. The method of claim 23, wherein the repeating includes repeating without inserting an isolation device into the casing conduit to fluidly isolate an uphole portion of the casing conduit from a downhole portion of the casing conduit.

25. The method of claim 23, wherein the method includes maintaining the pressure within the casing conduit while removing the completion assembly from the casing conduit, replenishing at least one of the perforation device and the sealing apparatus, reinserting the completion assembly into the casing conduit, and repeating the method.

26. A sealing apparatus configured to provide a secondary sealing agent to a perforation that is present within a wellbore casing that defines a casing conduit, the sealing apparatus comprising:

a charge of sealing material that includes the secondary sealing agent;

a delivery structure that retains the secondary sealing agent during conveyance of the sealing apparatus from a surface region and along the casing conduit to within a threshold distance of the perforation, wherein at least a portion of the delivery structure is formed from a frangible material that when destructed the frangible material forms a portion of the charge of sealing material; and a release mechanism that selectively releases the charge of sealing material from the delivery structure into the casing conduit to supplement a seal between the wellbore casing and a primary sealing agent and decrease a flow rate of a fluid from the casing conduit through the perforation.

27. The sealing apparatus of claim 26, wherein the delivery structure includes a delivery structure body that defines an internal chamber, and further wherein the charge of sealing material is contained within the internal chamber.

28. The sealing apparatus of claim 26, wherein the delivery structure includes a metallic tube that retains the charge of sealing material, wherein the metallic tube includes an uphole end and a downhole end, wherein the metallic tube further includes an inflow port, wherein the delivery structure further includes a frangible window operatively attached to the downhole end of the metallic tube, wherein the frangible window is configured to be broken apart by the release mechanism, wherein the frangible window is configured to retain the charge of sealing material within the delivery structure prior to being broken apart and to provide for release of the charge of sealing material from the delivery structure subsequent to being broken apart, wherein the release mechanism includes an explosive device, wherein the delivery structure further includes a retention structure, and further wherein the retention structure is configured to provide for fluid flow through the metallic tube but to retain the charge of sealing material within the metallic tube.

29. The sealing apparatus of claim 26, wherein the secondary sealing agent is configured to form a temporary seal between the wellbore casing and the primary sealing agent, and further wherein the secondary sealing agent is configured to accumulate between the primary sealing agent and the wellbore casing.

30. The sealing apparatus of claim 26, wherein the secondary sealing agent includes at least one of a web of material, a woven mat of material, strands of material, a random collection of fibers, a plurality of small spheres, a plurality of small spheres that define a plurality of sphere diameters, a plurality of particles, a plurality of particles that define a plurality of particle characteristic dimensions, a granular material, and combinations thereof.

31. The sealing apparatus of claim 26, wherein the secondary sealing agent includes a characteristic dimension, wherein the perforation includes a characteristic dimension, and further wherein the characteristic dimension of the secondary sealing agent is less than the characteristic dimension of the perforation.

32. The sealing apparatus of claim 26, wherein the charge of sealing material further includes the primary sealing agent.

33. The sealing apparatus of claim 26, wherein the secondary sealing agent is formed from at least one of steel wool, fiberglass, fiberglass insulation, wood, a biodegradable material, a polymeric material, a metallic material, a composite material, a ceramic material, a frangible material, a magnetic material, a frangible magnetic material, an expandable material, a material that expands upon exposure to the fluid, a material that expands upon absorption of the fluid, a compressed material that expands upon release from the delivery structure, a compressed material that is encapsulated in an encapsulation material that is soluble in the fluid and that expands upon dissolution of the encapsulation material within the fluid, a sponge, a compressed sponge, a naturally occurring material, and combinations thereof.

34. A completion assembly, comprising:

a perforation device; and the sealing apparatus of claim 26.

35. The completion assembly of claim 34, wherein the completion assembly includes a plurality of sealing apparatus.

36. The completion assembly of claim 35, wherein the plurality of sealing apparatus includes a plurality of respective release mechanisms, and further wherein each of the plurality of respective release mechanisms is configured to selectively release a respective charge of sealing material from a respective delivery structure of a respective sealing apparatus.

* * * * *